US012788197B2

(12) United States Patent
Sung et al.

(10) Patent No.: US 12,788,197 B2
(45) Date of Patent: Nov. 10, 2026

(54) MOVING ROBOTS AND METHOD FOR CONTROLLING THE SAME

(71) Applicant: LG ELECTRONICS INC., Seoul (KR)

(72) Inventors: Chulmo Sung, Seoul (KR); Hyungjin Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 405 days.

(21) Appl. No.: 17/801,835

(22) PCT Filed: Feb. 26, 2021

(86) PCT No.: PCT/KR2021/002453
§ 371 (c)(1),
(2) Date: Aug. 24, 2022

(87) PCT Pub. No.: WO2021/172932
PCT Pub. Date: Sep. 2, 2021

(65) Prior Publication Data

US 2023/0084829 A1 Mar. 16, 2023

(30) Foreign Application Priority Data

Feb. 26, 2020 (KR) ..... 10-2020-0023797

(51) Int. Cl.
*A47L 11/40* (2006.01)
*A47L 9/00* (2006.01)
(Continued)

(52) U.S. Cl.
CPC ..... *A47L 11/4011* (2013.01); *A47L 9/009* (2013.01); *A47L 9/2826* (2013.01); *A47L 9/2852* (2013.01);
(Continued)

(58) Field of Classification Search
CPC ..... G05D 2107/40; G05D 2105/10
See application file for complete search history.

(56) References Cited

U.S. PATENT DOCUMENTS 10,882,186 B1 * 1/2021 Ebrahimi Afrouzi ..... G05D 1/0221
2019/0212752 A1 * 7/2019 Fong ..... G05D 1/6987
(Continued)

FOREIGN PATENT DOCUMENTS

JP 2015-147091 8/2015
JP 2015-160022 9/2015
(Continued)

OTHER PUBLICATIONS

European Search Report dated Jul. 29, 2024 issued in Application No. 21759837.4.
(Continued)

*Primary Examiner* — Kaj K Olsen
*Assistant Examiner* — Richard Z. Zhang
(74) *Attorney, Agent, or Firm* — KED & ASSOCIATES

(57) ABSTRACT

The present disclosure relates to a method for controlling a plurality of moving robots, in which by dividing an area to be cleaned into a plurality of regions, and detecting sub-regions in the respective regions, the plurality of moving robots share information on the sub-region and the respective regions, and perform cleaning alternately to reduce the waste of cleaning time.

7 Claims, 14 Drawing Sheets

(51) Int. Cl.
*A47L 9/28* (2006.01)
*A47L 11/28* (2006.01)

(52) U.S. Cl.
CPC ..... *A47L 9/2894* (2013.01); *A47L 11/28* (2013.01); *A47L 11/4061* (2013.01); *A47L 9/2805* (2013.01); *A47L 2201/04* (2013.01); *A47L 2201/06* (2013.01)

(56) References Cited

U.S. PATENT DOCUMENTS

| | | | | |
|---|---|---|---|---|
| 2019/0337155 | A1 | 11/2019 | Kwak et al. | |
| 2020/0019178 | A1* | 1/2020 | Orzechowski | A47L 11/4011 |
| 2020/0293060 | A1* | 9/2020 | Jeong | A47L 11/4011 |
| 2021/0068605 | A1* | 3/2021 | Kim | A47L 9/2857 |
| 2021/0124354 | A1* | 4/2021 | Munich | G05D 1/227 |

FOREIGN PATENT DOCUMENTS

| | | |
|---|---|---|
| KR | 10-2014-0138555 | 10/2014 |
| KR | 10-2017-0033579 | 3/2017 |
| KR | 10-2019-0073140 | 6/2019 |
| KR | 10-2019-0134969 | 12/2019 |
| KR | 10-2020-0010635 | 1/2020 |
| KR | 10-2067603 | 1/2020 |
| KR | 10-2020-0013177 | 2/2020 |
| WO | WO 2019/135518 | 7/2019 |
| WO | WO 2020/004834 | 1/2020 |

OTHER PUBLICATIONS

International Search Report dated Jun. 9, 2021 issued in Application No. PCT/KR2021/002453.

* cited by examiner

[Fig. 1]
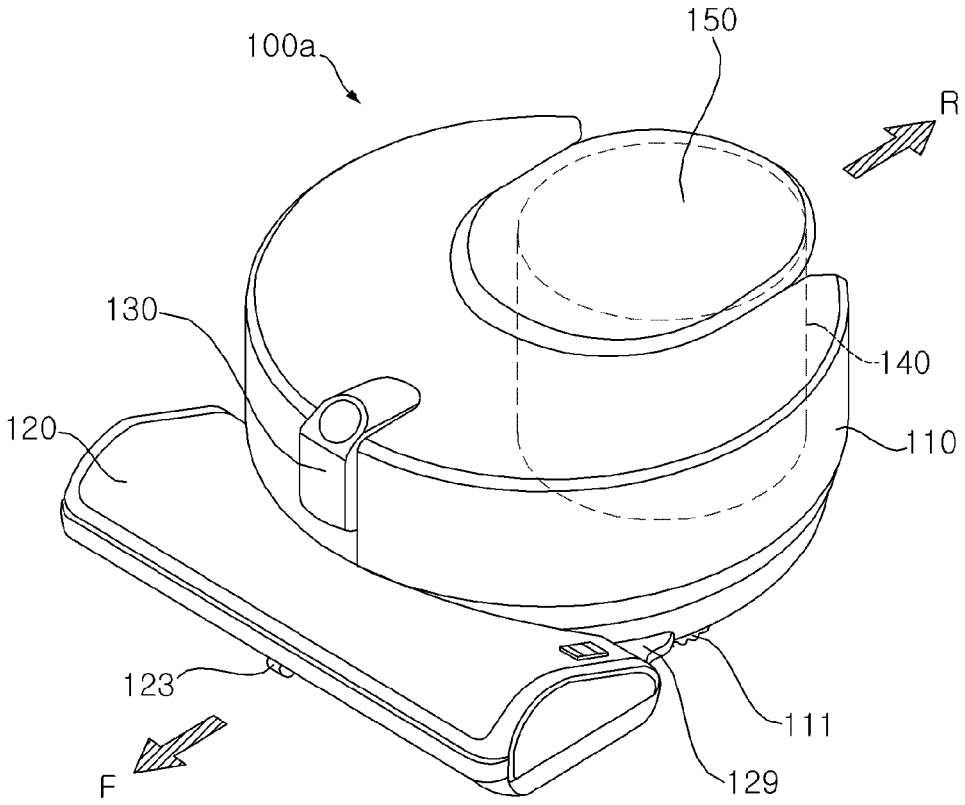

[Fig. 2]
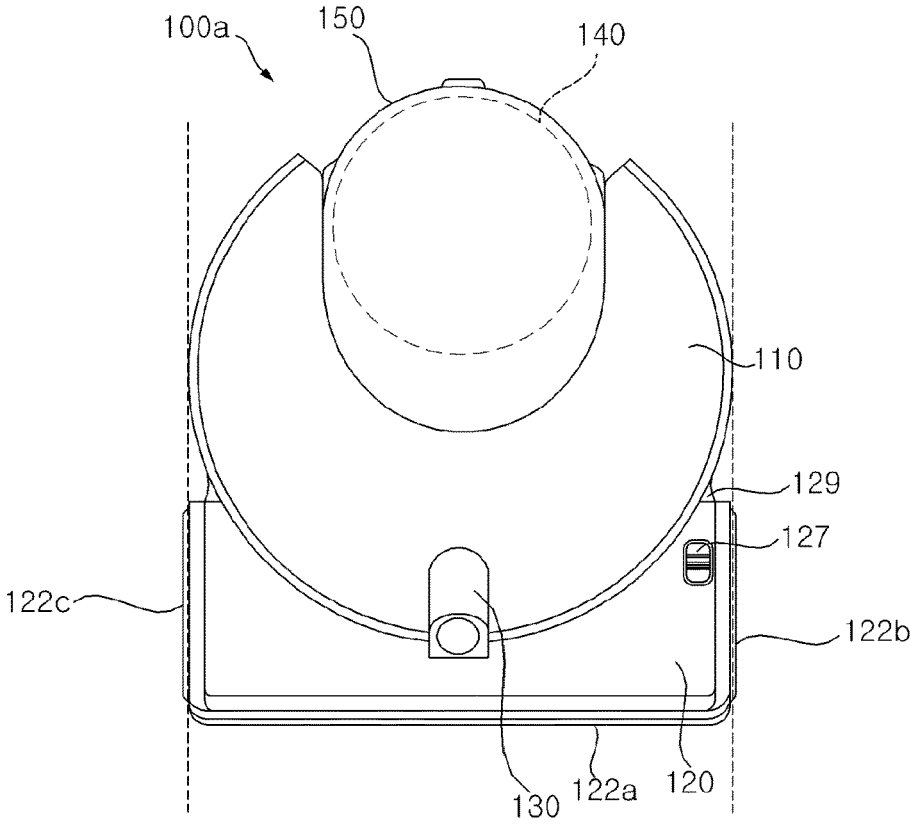
[Fig. 3]
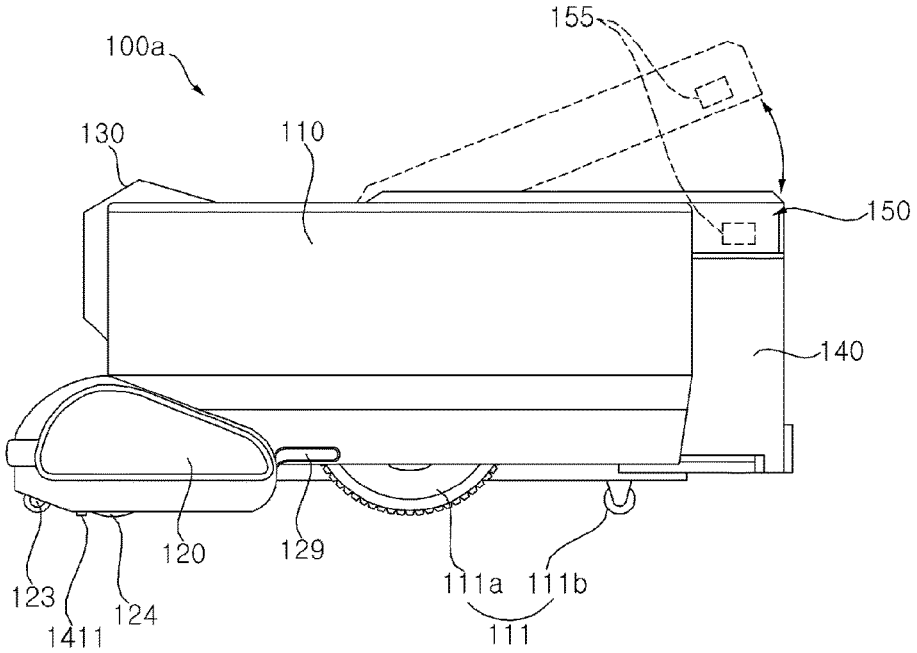

[Fig. 4]
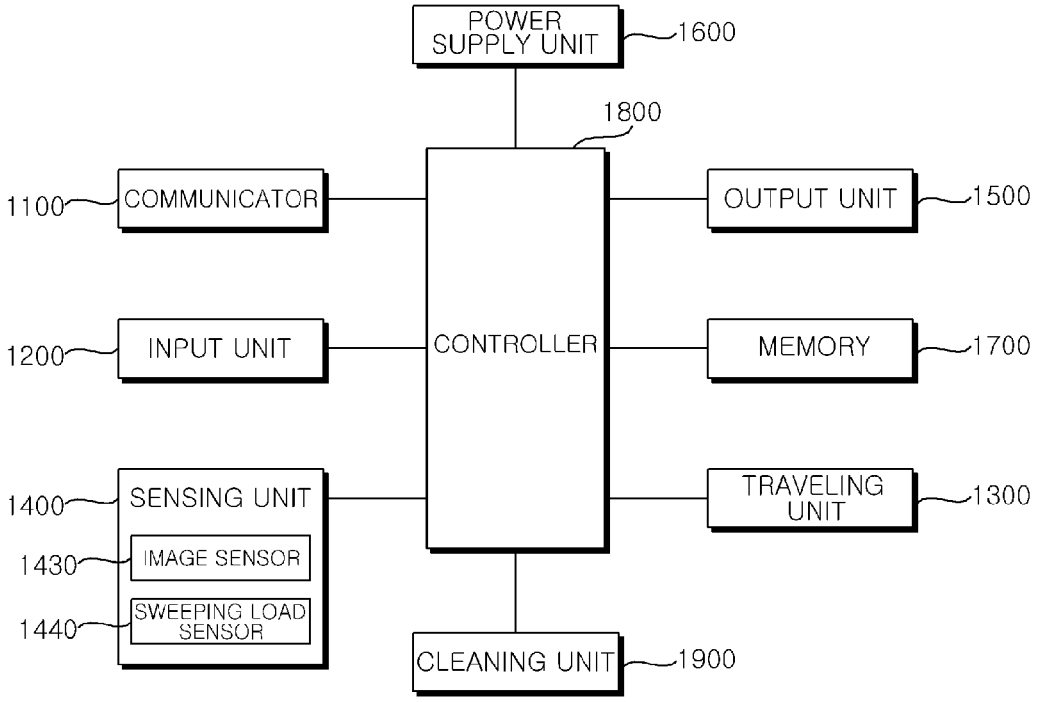
[Fig. 5]
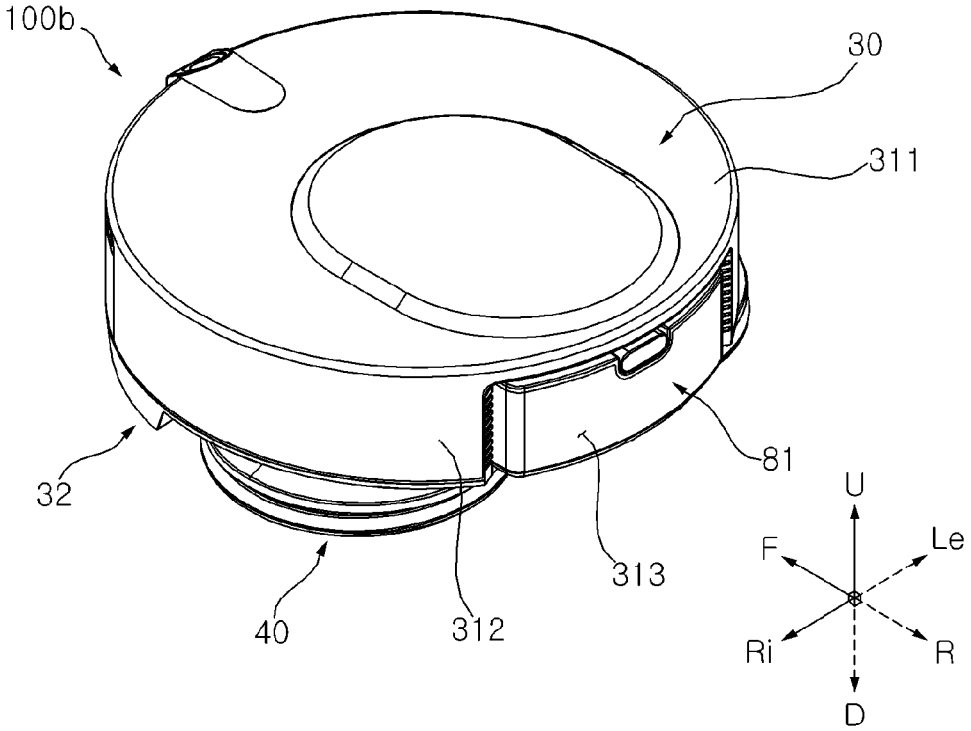

[Fig. 6]
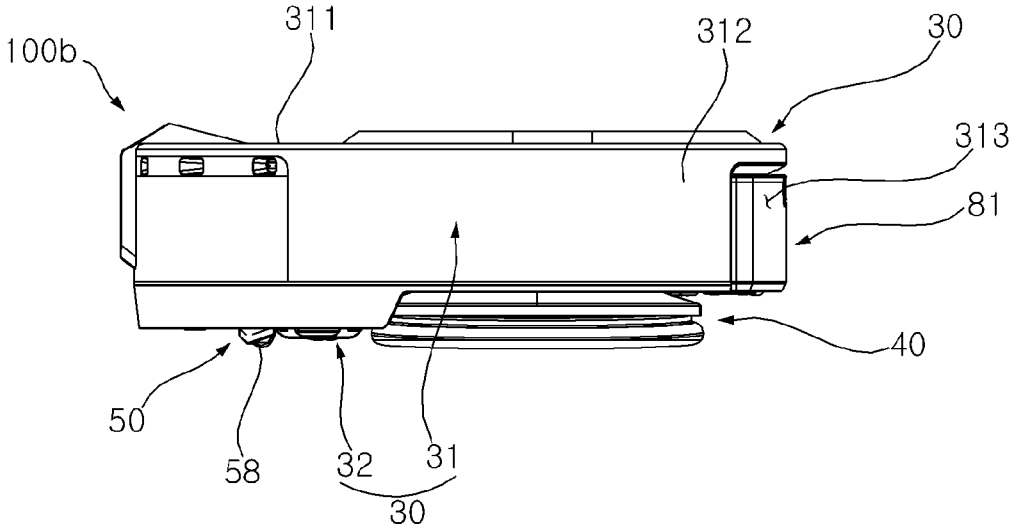
[Fig. 7]
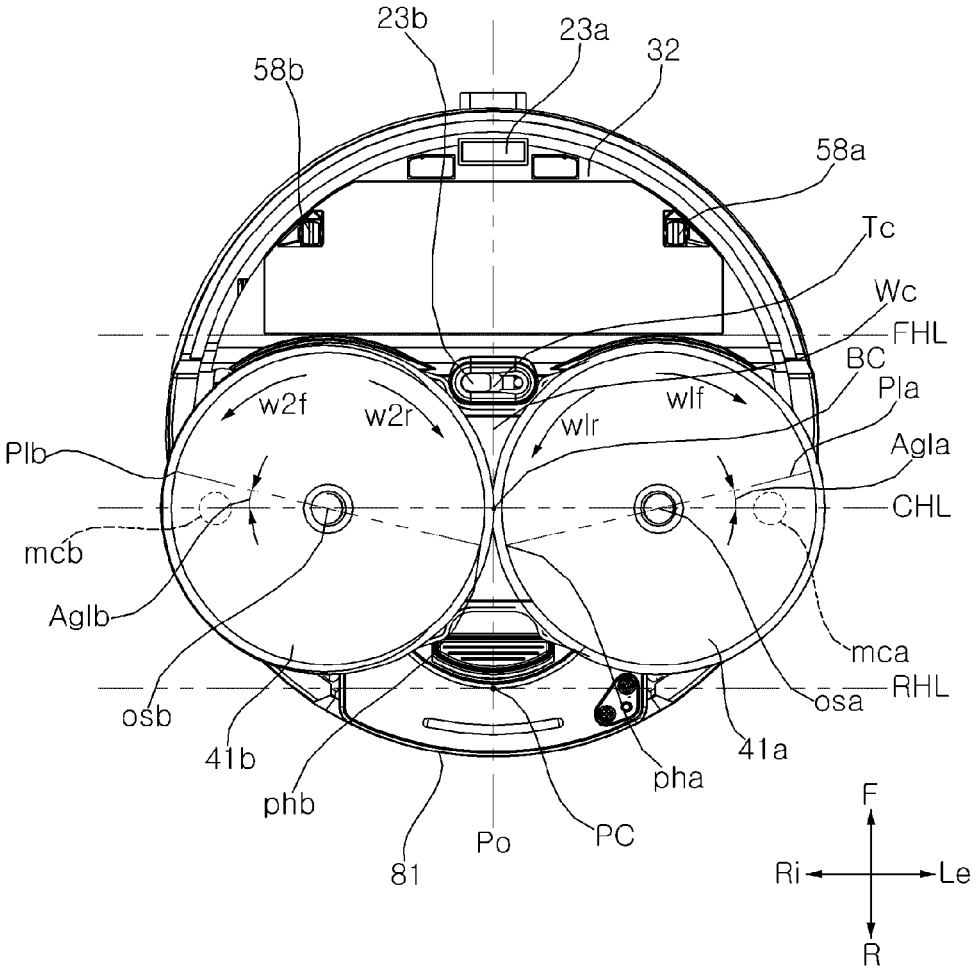

[FIG. 8]
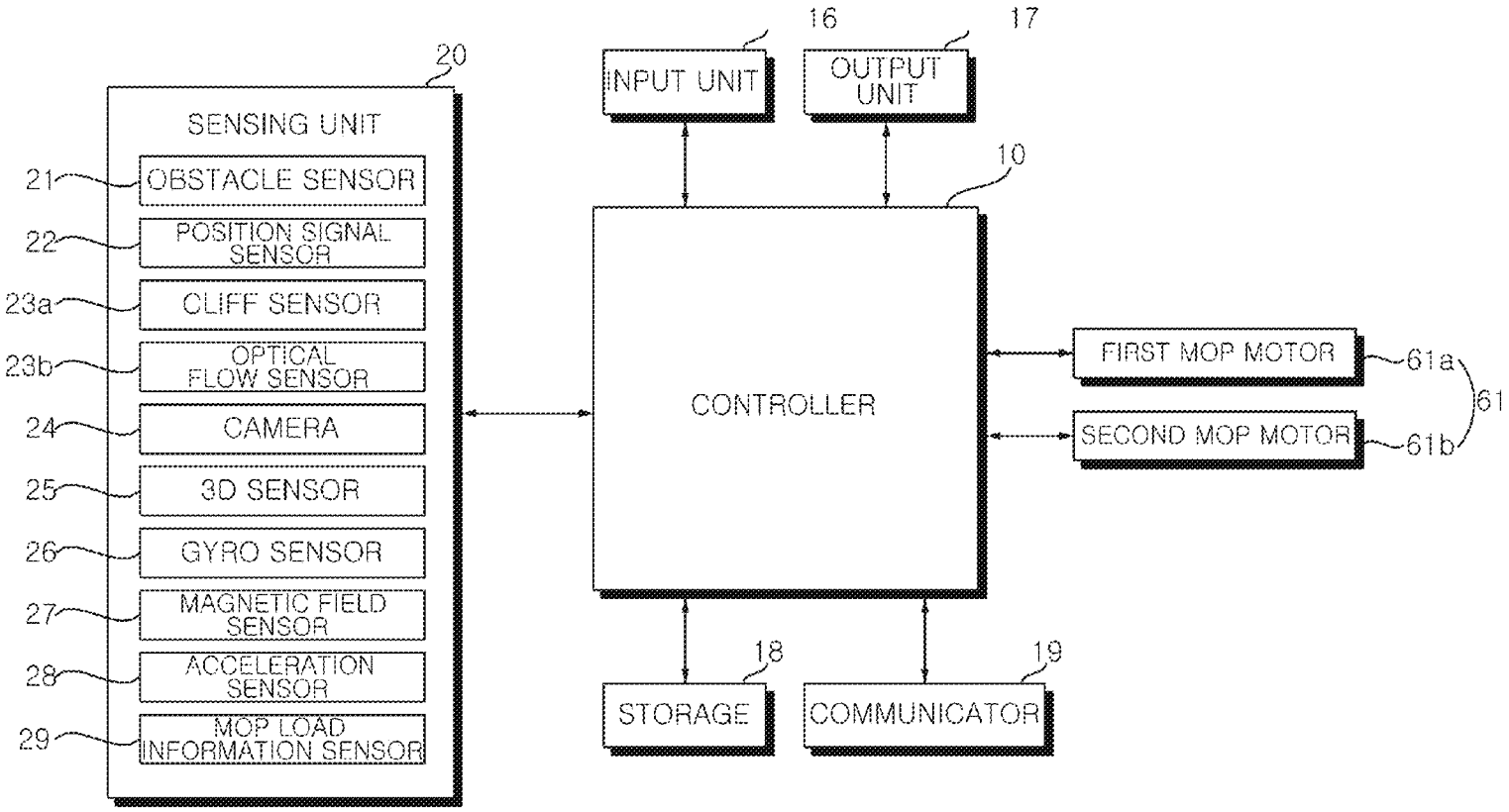

[Fig. 9a]
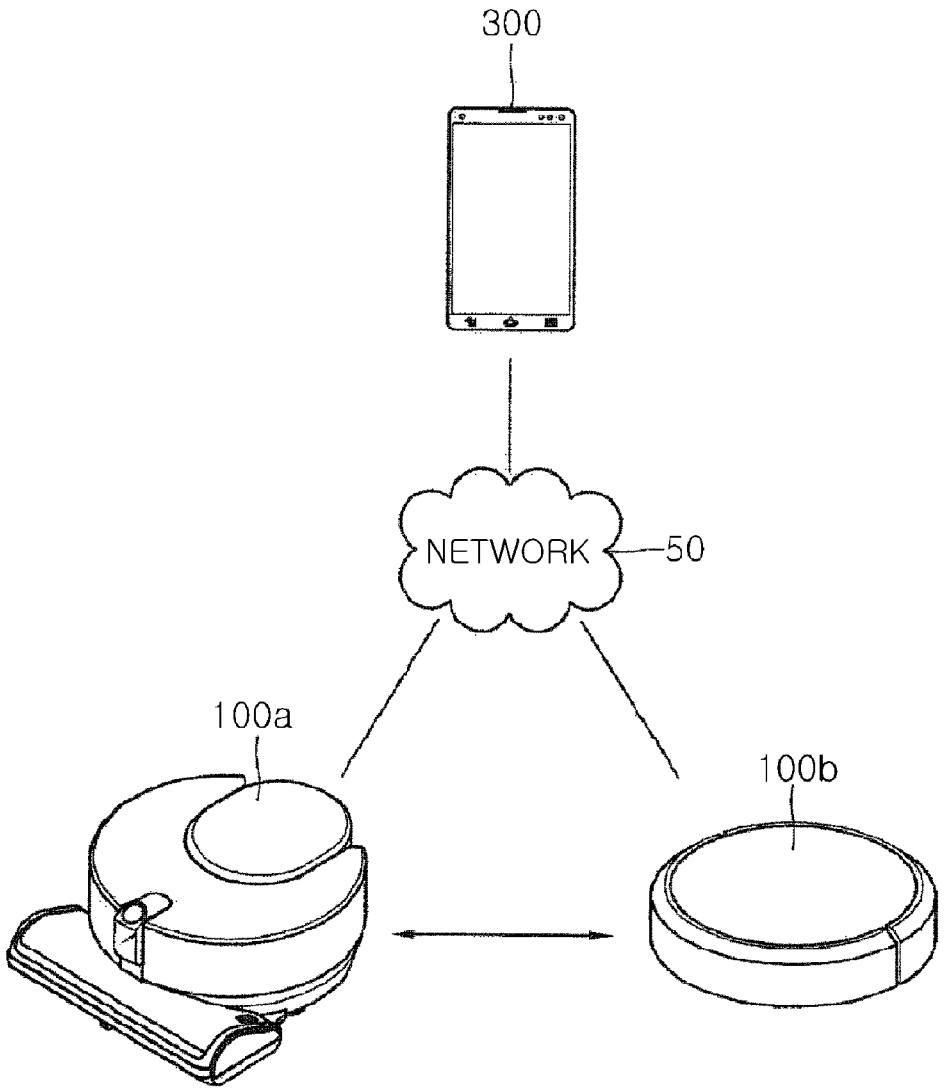

[Fig. 9b]
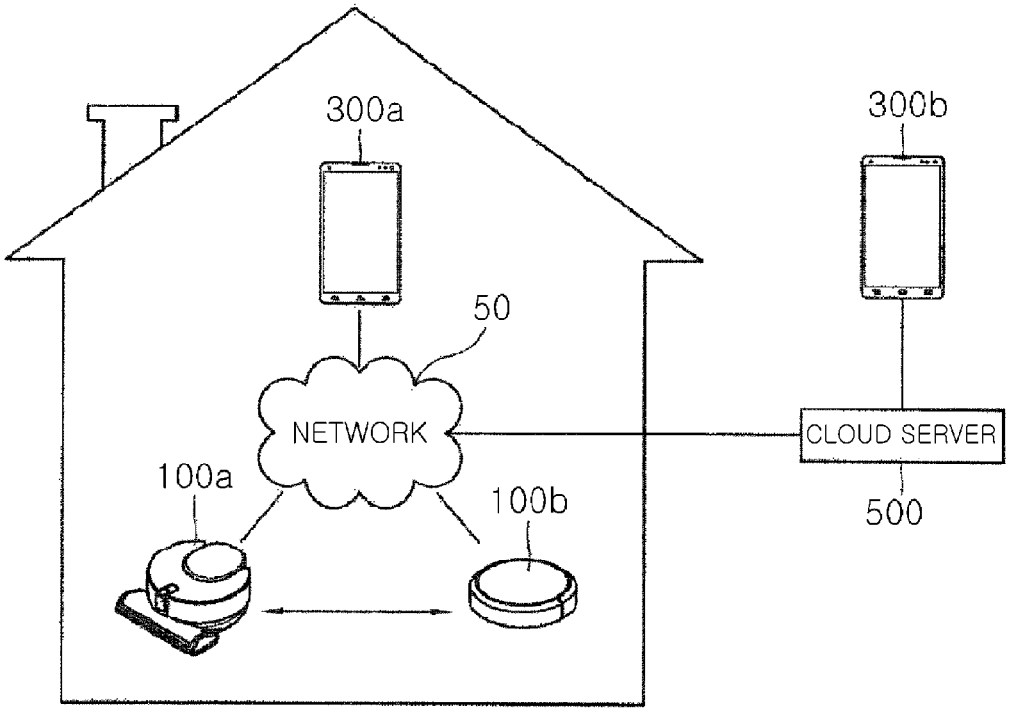
[Fig. 9c]
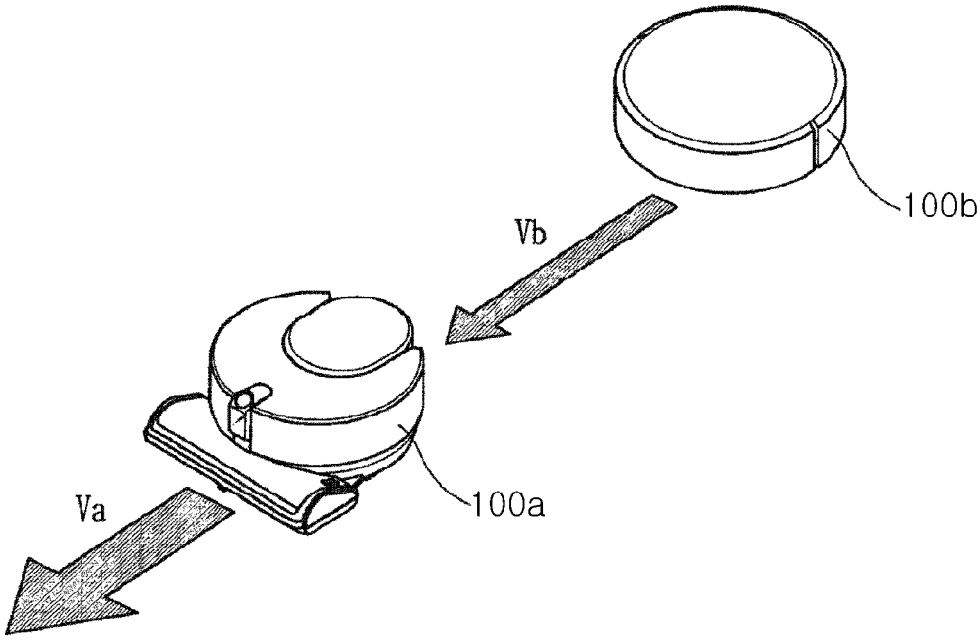

[FIG. 10]
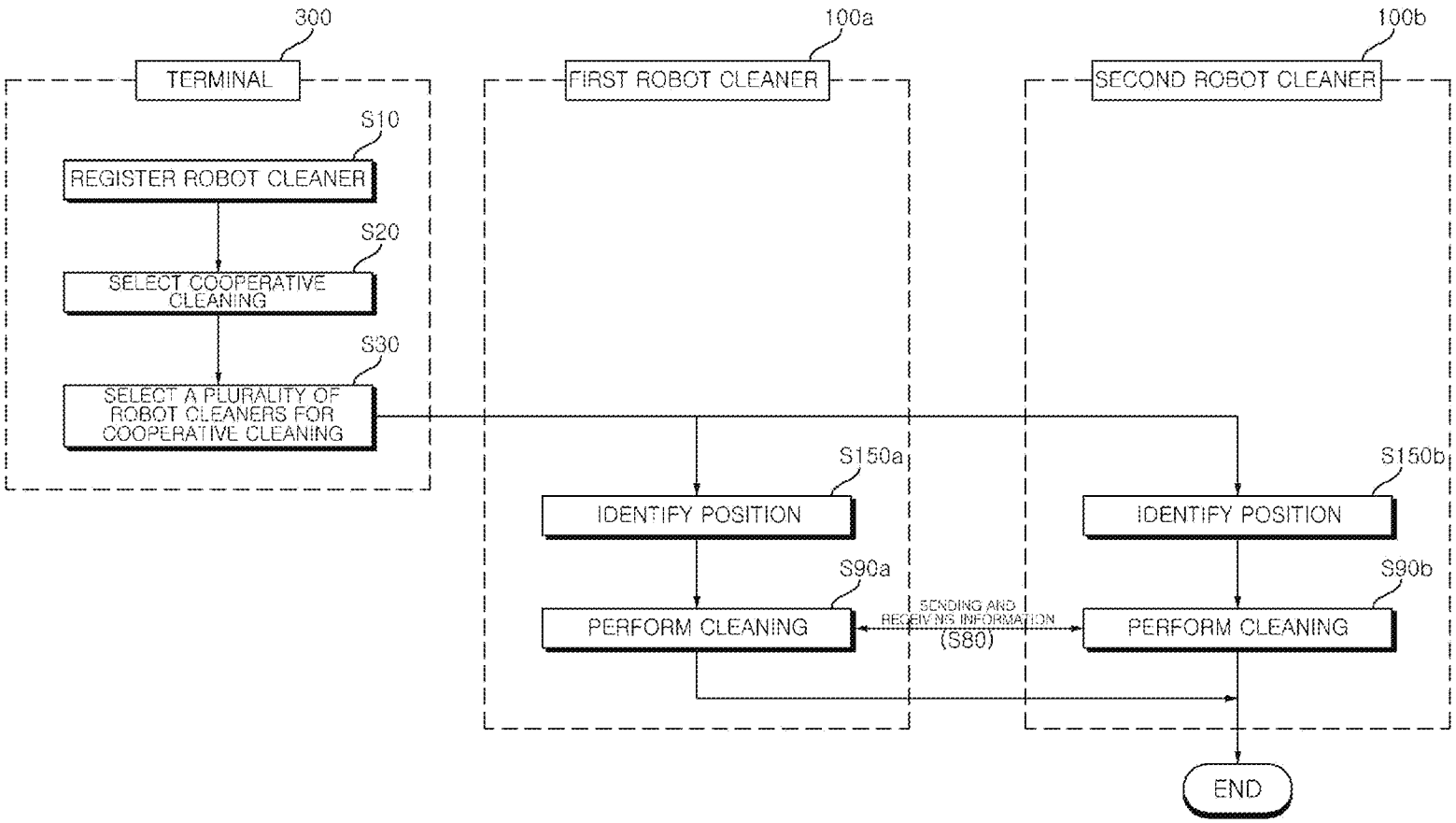

[Fig. 11a]
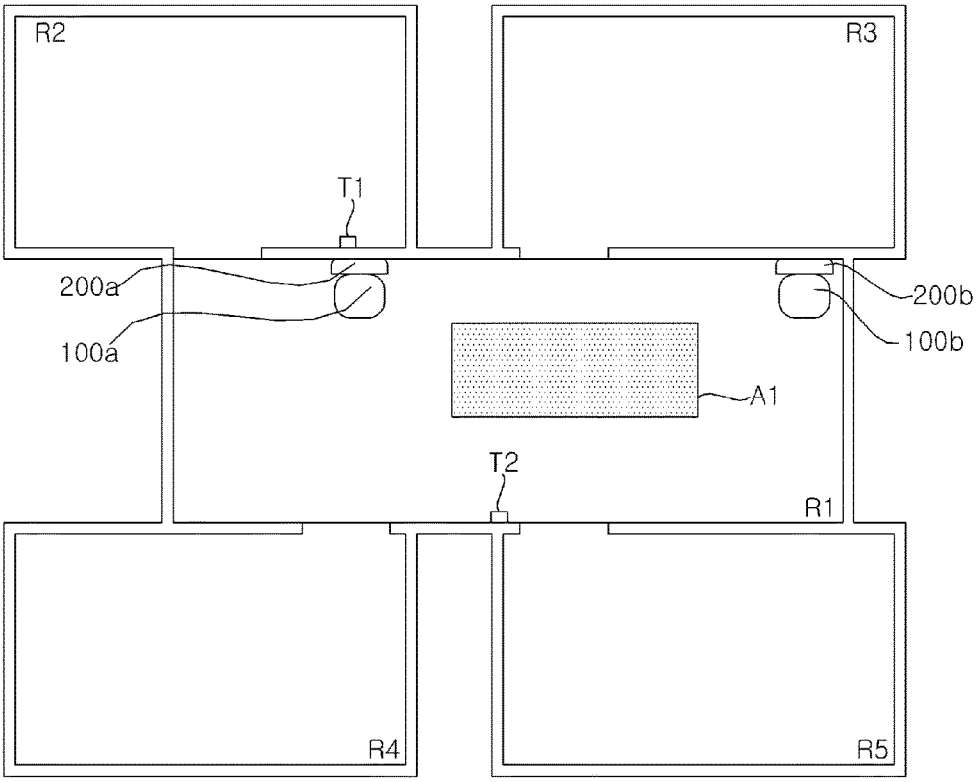
[Fig. 11b]
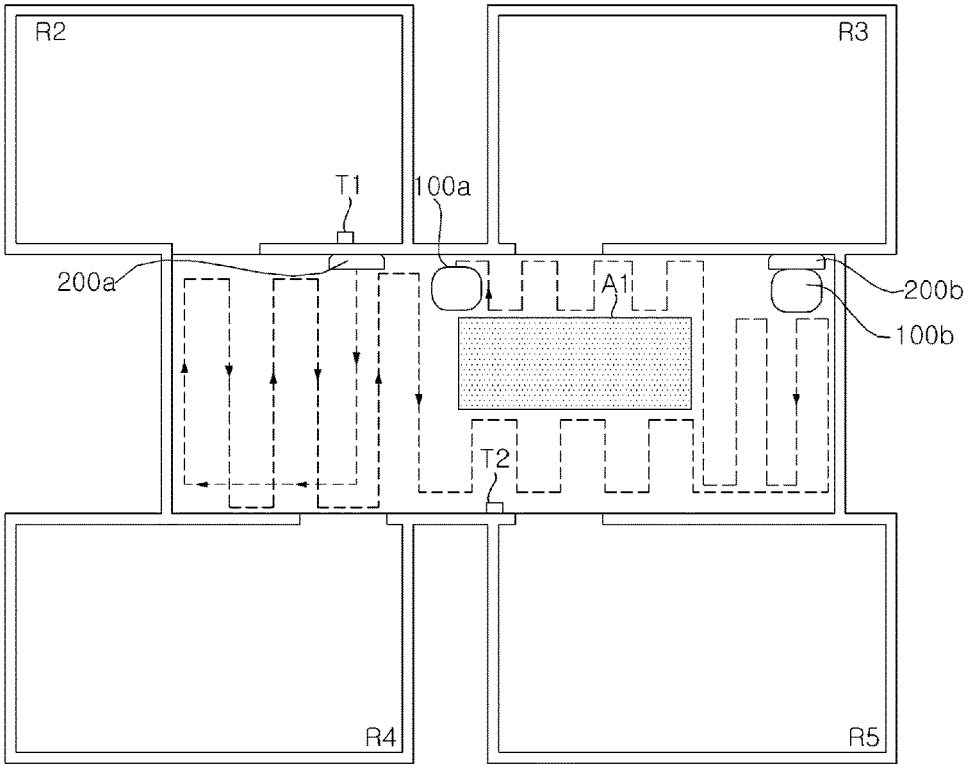

[Fig. 11c]
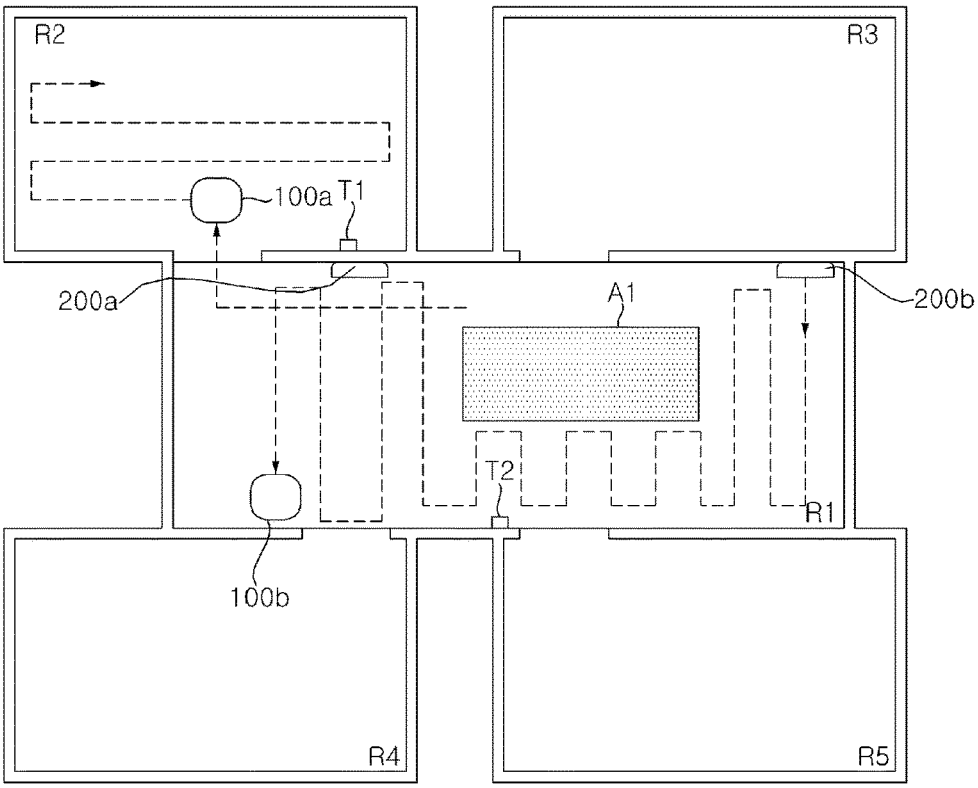
[Fig. 11d]
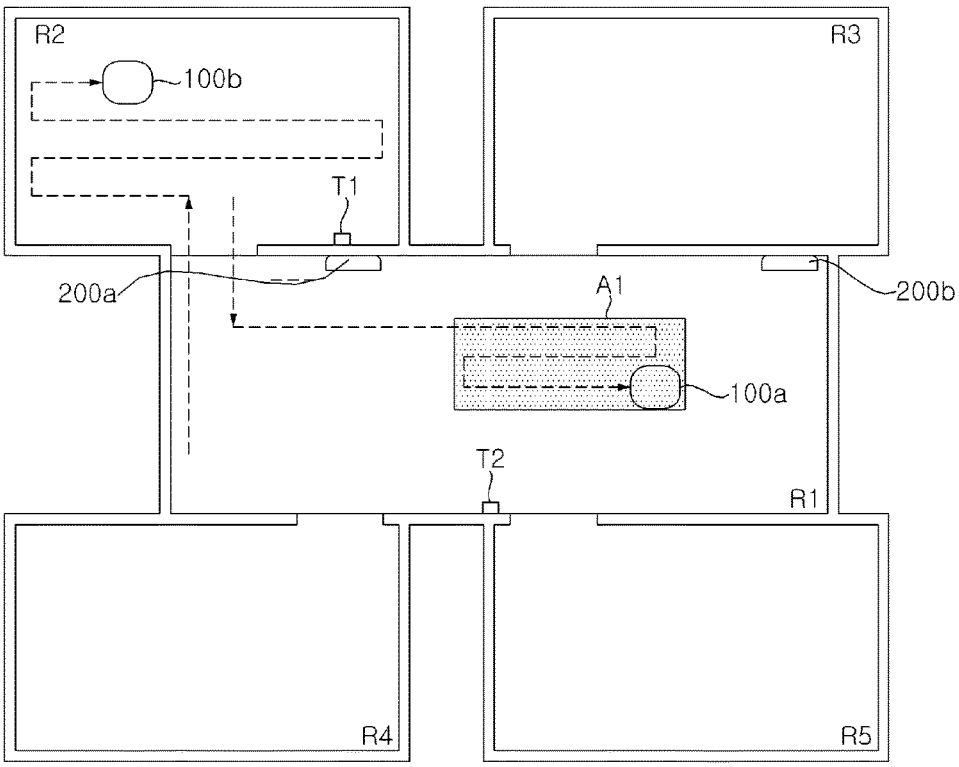

[Fig. 12]
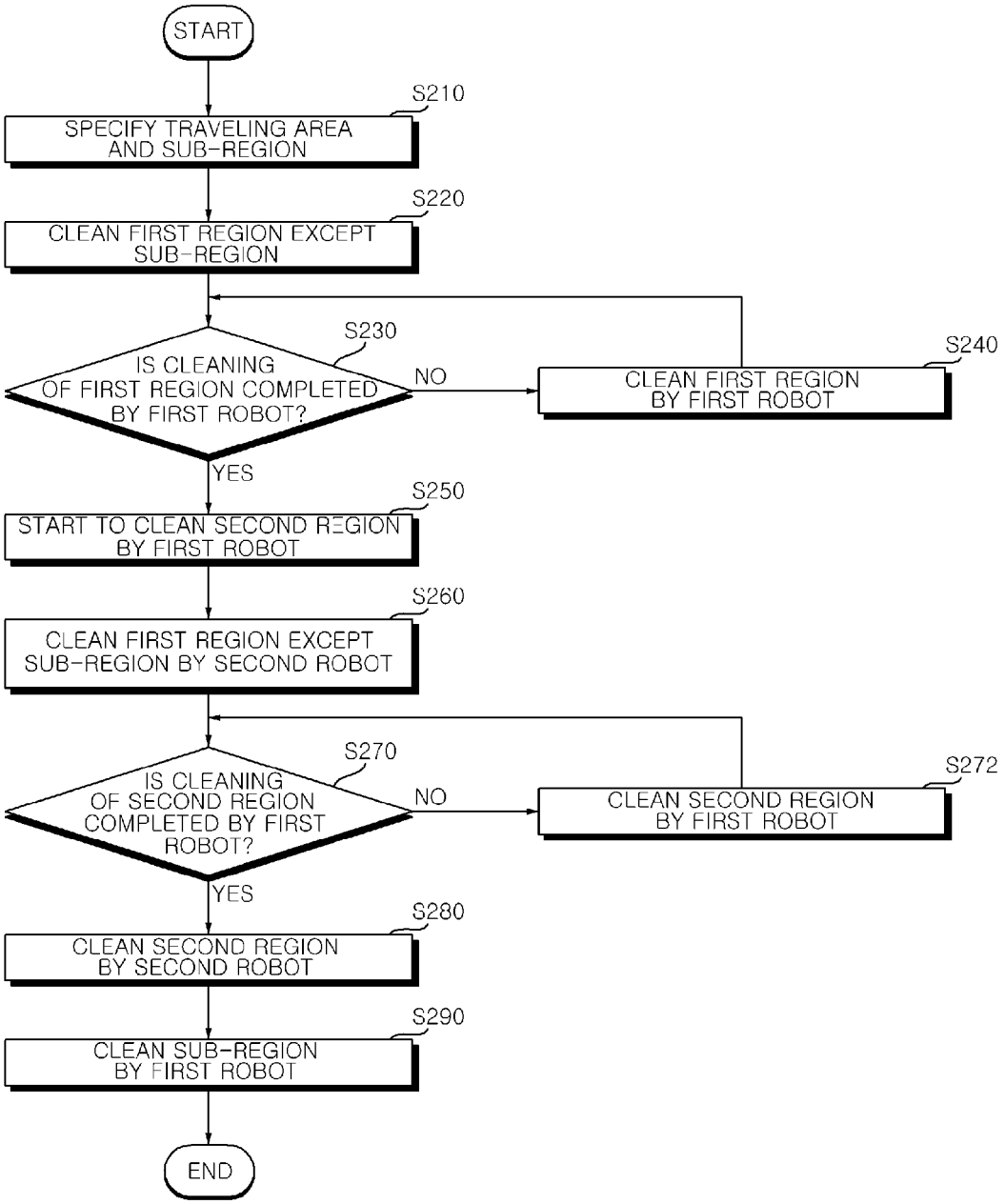

[Fig. 13]
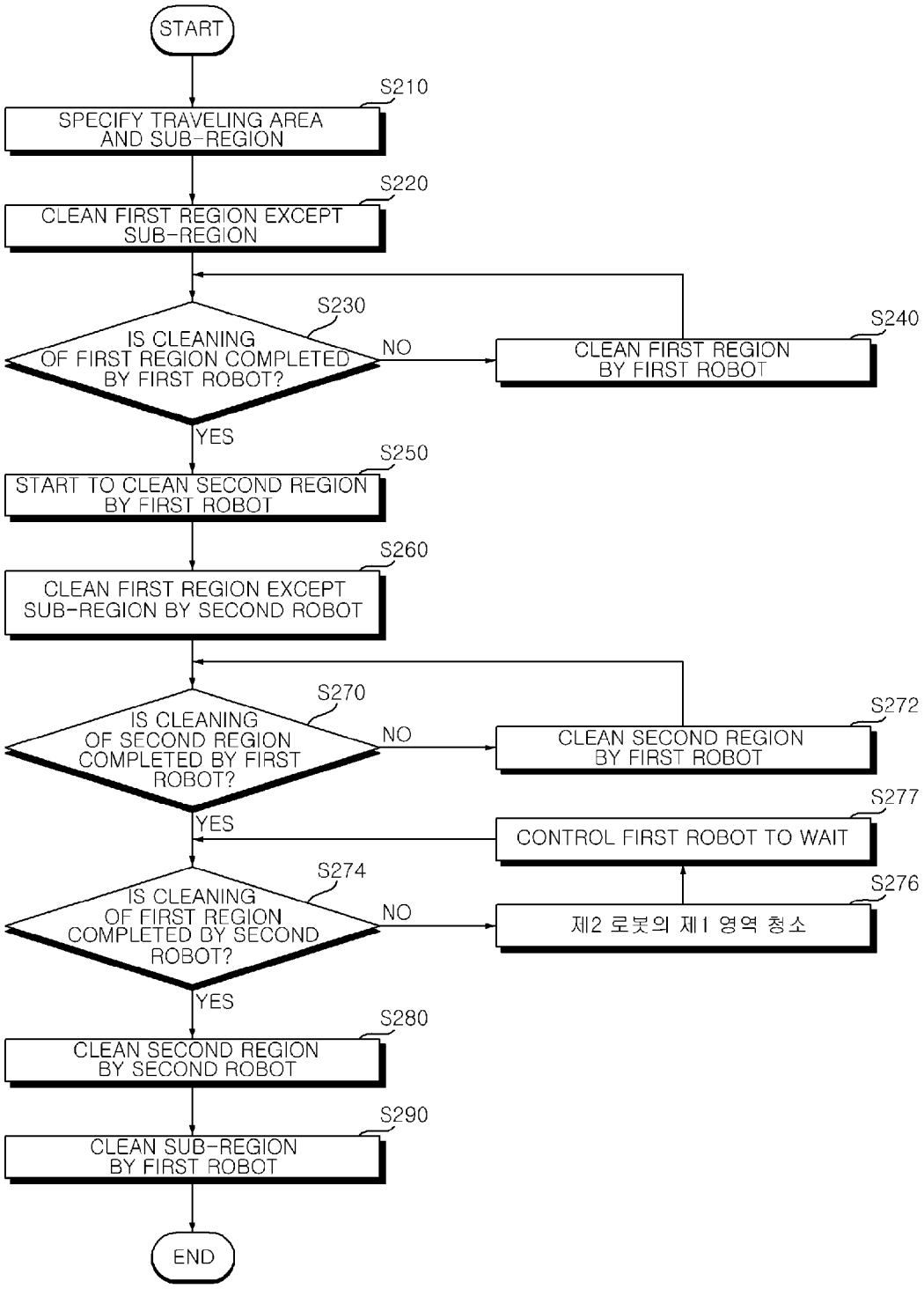

[Fig. 14]
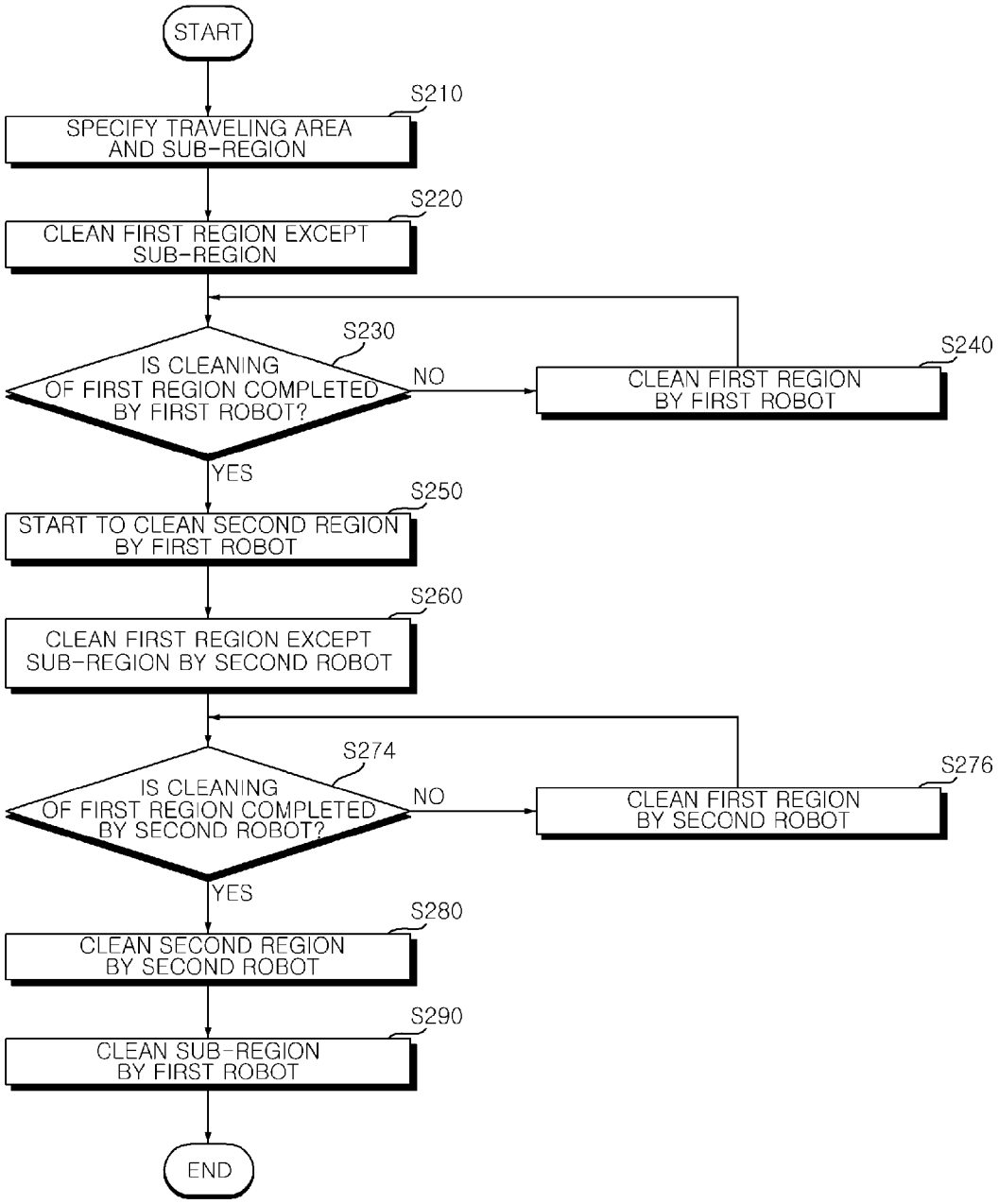

[Fig. 15]
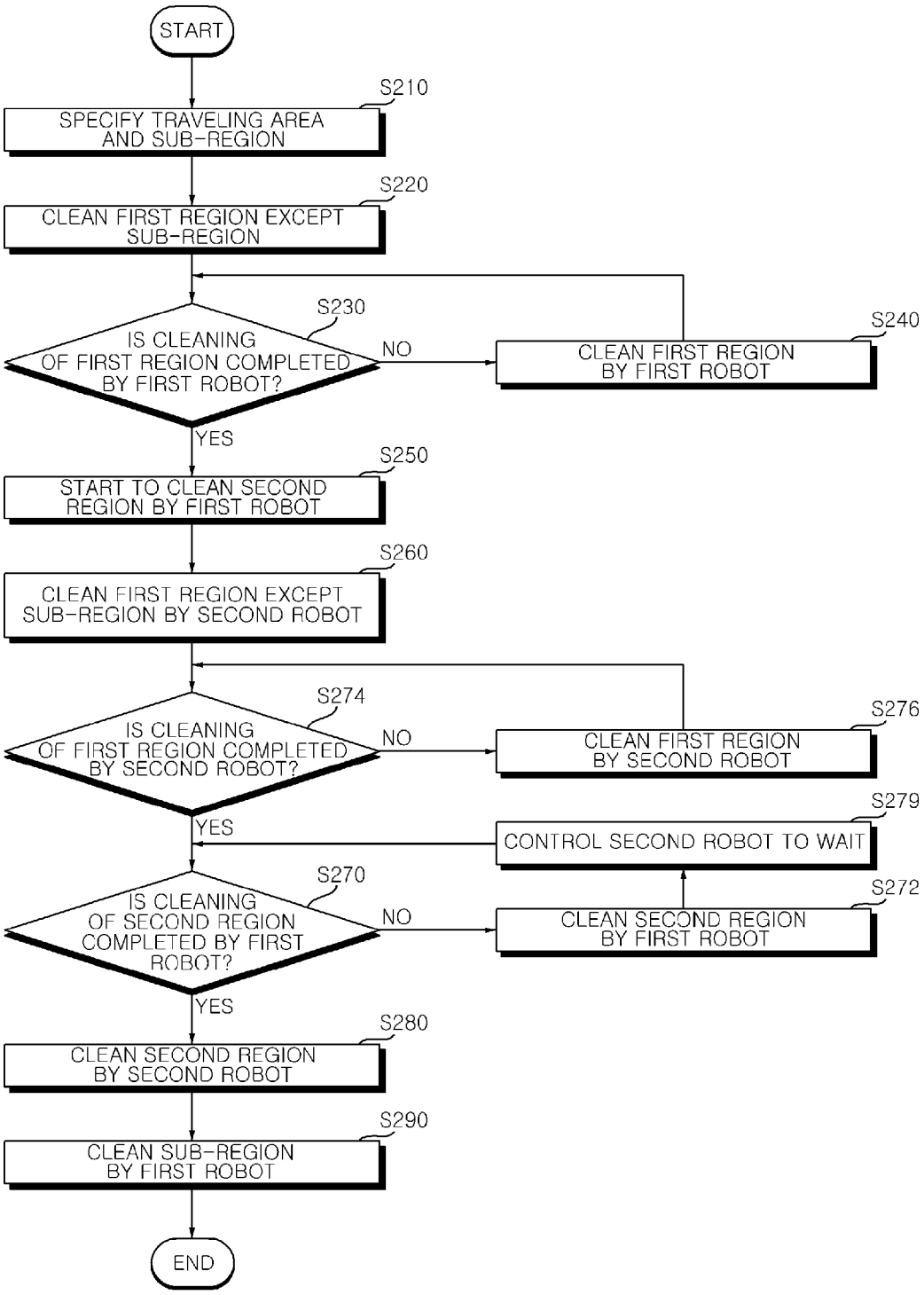

MOVING ROBOTS AND METHOD FOR CONTROLLING THE SAME

CROSS-REFERENCE TO RELATED PATENT APPLICATIONS

This application is a U.S. National Stage Application under 35 U.S.C. § 371 of PCT Application No. PCT/KR2021/002453, filed Feb. 26, 2021, which claims priority to Korean Patent Application No. 10-2020-0023797, filed Feb. 26, 2020, whose entire disclosures are hereby incorporated by reference.

TECHNICAL FIELD

The following description relates to moving robots, and more particularly to a plurality of moving robots capable of performing cooperative cleaning by sharing a map.

BACKGROUND ART

Robots have been developed for industrial use and have been part of factory automation. Recently, the application filed of robots has been expanded, such that medical robots, aerospace robots, and the like have been developed and household robots that can be used in ordinary houses have also been manufactured. Among these robots, a robot that can travel by itself is called a moving robot. A typical example of the moving robot used in home is a robot cleaner.

There are many known techniques for sensing the surroundings of a moving robot and a user by using various sensors provided for the moving robot. Further, there are also techniques for allowing the moving robot to map an area to be cleaned by learning the area and identifying a current position on the map. There is a moving robot which cleans an area to be cleaned while traveling the area in a predetermined manner.

For determining a distance from an obstacle and mapping in the surroundings of the cleaner, an existing moving robot may use an optical sensor which may easily determine the distance and may detect terrain features and obstacles.

Furthermore, a related art (Korean Laid-open Patent Publication No. 10-2014-0138555) discloses a method of using a plurality of sensors to generate a map, in which a plurality of robots, sharing the map, identify positions based on an initial start point, and the respective robots have their own start point, thereby causing a problem in that positions of other robots and environment information may not be known.

Particularly, by using different methods of generating a map and due to a difference in the type and sensitivity of various sensors, different types of robots may generate different maps for the same area to be cleaned, thereby causing a problem in that the size and coordinate direction of the respective maps do not coincide with each other. Further, if the maps are different from each other, it is difficult for the robots to share position information and environment information, such that cooperative cleaning is unable to be performed.

In order for a plurality of moving robots to perform cooperative cleaning efficiently, the moving robots should identify each other's positions. To this end, the moving robots may further include a position sensor, such as an ultrasonic sensor, radar, etc., to identify each other's positions, but if a spaced-apart distance between the moving robots increases, there is a drawback in that the moving robots are difficult to identify the positions. In order to overcome such drawback, a high-performance sensor for accurately identifying each other's positions may be mounted in the moving robots, but such sensor may increase the overall production costs.

In addition, the plurality of moving robots perform cleaning using different methods, such that there may be regions in which cleaning is able to be performed, and regions in which cleaning is unable to be performed. Specifically, if a wet cleaner detects a floor obstacle, such as a carpet and the like, and moves into the carpet, a problem occurs in that the wet cleaner is trapped by the carpet and unable to move.

Furthermore, in the related art, cleaning is performed by dividing an area to be cleaned into five regions, and if there is a region in which a wet-type cleaning is unable to be performed, a drying-type moving robot first cleans both a dry region and the region in which the wet-type cleaning is unable to be performed, and then a wet-type moving robot starts to perform cleaning, such that a longer cleaning time is required and a waiting time of the wet-type moving robot increases.

PRIOR ART DOCUMENT

Patent Document

Korean Laid-open Patent Publication No. 10-2014-0138555

DISCLOSURE OF INVENTION

Technical Problem

It is an object of the present disclosure to provide a plurality of moving robots and a method for controlling the same, in which the plurality of moving robots using different cleaning methods may efficiently clean an area to be cleaned by performing cooperative cleaning in the same area.

It is another object of the present disclosure to provide a plurality of moving robots and a method for controlling the same, in which upon detecting sub-regions, the dry-type robot and the wet-type robot may efficiently perform cooperative cleaning of the sub-regions.

It is yet another object of the present disclosure to provide a plurality of moving robots and a method for controlling the same, in which by dividing the area to be cleaned into a plurality of regions, and by efficiently determining a cleaning sequence of a dry-type robot and a wet-type robot to clean sub-regions and the respective regions, thereby reducing a total cleaning time.

It is still another object of the present disclosure to provide a plurality of moving robots and a method for controlling the same, in which a map, identified by any one of the plurality of moving robots, is shared by another robot, such that the plurality of moving robots may perform cooperative cleaning efficiently.

Solution to Problem

In order to achieve the above objects, the present disclosure provides a method for controlling a plurality of moving robots, in which by dividing an area to be cleaned into a plurality of regions, and detecting sub-regions in the respective regions, the plurality of moving robots may share information on the sub-region and the respective regions, and perform cleaning alternately to reduce the waste of cleaning time.

Specifically, in accordance with an aspect of the present disclosure, the above and other objects can be accomplished by providing a method for controlling a plurality of moving robots, the method including: dividing a traveling area into at least a plurality of first and second regions; by a first moving robot, detecting a sub-region in the first region; performing a first dry cleaning step of cleaning the first region except the sub-region, by the first moving robot; upon completing cleaning of the first region, except the sub-region, by the first moving robot, performing a second dry cleaning step of cleaning the second region by the first moving robot; and upon completing cleaning of the first region, except the sub-region, by the first moving robot, performing a first wet cleaning step of starting to clean the first region, except the sub-region, by the second moving robot.

The method of controlling the plurality of moving robots may further include, upon completing cleaning of the second region by the first moving robot, performing a third dry cleaning step of cleaning the sub-region of the first region by the first moving robot.

In addition, the method of controlling the plurality of moving robots may further include, upon completing cleaning of the second region by the first moving robot and upon completing cleaning of the first region, except the sub-region, by the second moving robot, performing a third dry cleaning step of cleaning the sub-region of the first region by the first moving robot.

In the third dry cleaning step, if the second moving robot is in a process of cleaning the first region except the sub-rection, the first moving robot may wait in place.

Upon completing cleaning of the first region except the sub-region, the second moving robot may transmit information, indicating that cleaning of the first region is complete, to the first moving robot.

In addition, the method of controlling the plurality of moving robots may further include, upon completing cleaning of the first region except the sub-region by the second moving robot, performing a second wet cleaning step of starting to clean the second region by the second moving robot.

Moreover, the method of controlling the plurality of moving robots may further include, upon completing cleaning of the first region except the sub-region by the second moving robot and upon completing cleaning of the second region by the first moving robot, performing a second wet cleaning step of starting to clean the second region by the second moving robot.

In the second wet cleaning step, if the first moving robot is in a process of cleaning the second region, the second moving robot may wait in place.

Upon completing cleaning of the second region, the first moving robot may transmit information, indicating that cleaning of the second region is complete, to the second moving robot.

The first moving robot and the second moving robot may share a map of the traveling area.

The first moving robot may suction foreign matter; and the second moving robot may perform mopping.

In accordance with another aspect of the present disclosure, the above and other objects can be accomplished by providing a method for controlling a plurality of moving robots, the method including: by a first moving robot, sequentially cleaning sub-regions of divided first to p-th regions in a traveling area; upon starting to clean an n-th region by the first moving robot, starting to clean an n-1th region except the sub-regions by the second moving robot; and upon completing cleaning of the p-th region by the first moving robot, starting to clean the sub-regions in the first to p-th regions by the first moving robot.

In accordance with yet another aspect of the present disclosure, the above and other objects can be accomplished by providing a moving robot, including: a traveling unit configured to move a main body; a cleaning unit configured to suction dust; an image sensor configured to acquire surrounding images of the main body; and a controller configured to specify a traveling area, to divide the traveling area into at least a plurality of first and second regions, and to specify a sub-region, based on information input from the image sensor, wherein in response to the sub-region being located in the first region, the controller may control the traveling unit and the cleaning unit to clean the first region, except the sub-region and then to start to clean the second region, and to clean the sub-region in the first region after completing cleaning of the second region.

The controller may transmit position information of a region, in which wet cleaning is unable to be performed, to a second moving robot configured to perform cleaning in a different manner from the moving robot.

Once the second moving robot receives information indicating that cleaning of the first region is complete, the controller may control the traveling unit and the cleaning unit to clean the sub-region in the first region.

Once cleaning of the first region is complete, the controller may transmit position information of the region, in which the wet cleaning is unable to be performed, and a cleaning command to clean the sub-region in the first region, to the second moving robot.

In response to the sub-region being located in any one of the plurality of regions in the traveling area, the controller may define a region, in which the sub-region is located, as the first region.

Advantageous Effects of Invention

The moving robot according to the present disclosure has one or more of the following effects.

First, a plurality of moving robots may divide an area to be cleaned into regions where cleaning is able to be performed, and regions where cleaning is unable to be performed, such that the moving robots may perform cleaning appropriately according to a state of the area to be cleaned.

Second, in the case where a dry-type robot detects a sub-region during cleaning, the moving robot shares information on the sub-region with a wet-type moving robot; and while the dry-type robot skips the sub-region and cleans another region, the wet-type robot cleans the sub-region, thereby reducing a waiting time of the wet-type robot as well as a total cleaning time.

Third, the dry-type robot, capable of climbing the sub-region, first detects the sub-region and transmits information on the sub-region to the wet-type robot, such that the wet-type robot is not required to specify the sub-region by taking a risk of being confined in the region, thereby reducing the risk of confinement of the wet-type robot.

Fourth, in the present disclosure, the plurality of moving robots share information on whether cleaning of the respective regions is complete and information on the progress of cleaning, thereby reducing the waste of cleaning time, which occurs due to a difference in cleaning time of the respective regions having different sizes.

The effects of the present disclosure are not limited to the aforesaid, and other effects not described herein will be clearly understood by those skilled in the art from the following description of the appended claims.

BRIEF DESCRIPTION OF DRAWINGS

FIG. 1 is a perspective view of a moving robot according to an embodiment of the present disclosure.

FIG. 2 is a plan view of the moving robot illustrated in FIG. 1.

FIG. 3 is a side view of the moving robot illustrated in FIG. 1.

FIG. 4 is a block diagram illustrating exemplary components of the moving robot illustrated in FIG. 1.

FIG. 5 is a perspective view of a moving robot according to another embodiment of the present disclosure.

FIG. 6 is a side view of the moving robot illustrated in FIG. 5.

FIG. 7 is a bottom view of the moving robot illustrated in FIG. 5.

FIG. 8 is a block diagram illustrating exemplary components of the moving robot illustrated in FIG. 5.

FIG. 9A is a schematic diagram illustrating a network communication between a plurality of moving robots according to an embodiment of the present disclosure, and FIG. 9B is a schematic view illustrating an example of the network communication of FIG. 9A.

FIG. 9C is a diagram explaining a method of controlling the following of a plurality of moving robots according to an embodiment of the present disclosure.

FIG. 10 is a representative flowchart explaining a method of cooperative cleaning performed by a plurality of moving robots according to an embodiment of the present disclosure.

FIGS. 11A to 11D are schematic diagrams illustrating cooperative cleaning performed by a plurality of moving robots according to an embodiment of the present disclosure.

FIG. 12 is a flowchart illustrating a method for controlling a plurality of moving robots according to a first embodiment of the present disclosure.

FIG. 13 is a flowchart illustrating a method for controlling a plurality of moving robots according to a second embodiment of the present disclosure.

FIG. 14 is a flowchart illustrating a method for controlling a plurality of moving robots according to a third embodiment of the present disclosure.

FIG. 15 is a flowchart illustrating a method for controlling a plurality of moving robots according to a fourth embodiment of the present disclosure.

BEST MODE FOR CARRYING OUT THE INVENTION

Advantages and features of the present disclosure and methods for accomplishing the same will be more clearly understood from exemplary embodiments described below with reference to the accompanying drawings. However, the present disclosure is not limited to the following embodiments but may be implemented in various different forms. The embodiments are provided only to complete disclosure of the present disclosure and to fully provide a person having ordinary skill in the art to which the present disclosure pertains with the category of the present disclosure, and the present disclosure will be defined by the scope of the appended claims. Wherever possible, the same reference numbers will be used throughout the drawings to refer to the same or like parts.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

A moving robot 100 of the present disclosure refers to a robot capable of moving by itself with wheels and the like, and examples thereof may include a domestic robot, a robot cleaner, and the like.

Hereinafter, a moving robot relevant to the present disclosure will be described in further detail with reference to the accompanying drawings.

Reference will now be made in detail to embodiments of the present disclosure, examples of which are illustrated in the accompanying drawings, but it should be noted that the technical terms used in this specification are merely used to describe a particular embodiment and are not intended to limit the technical idea disclosed in this specification.

FIG. 1 is a perspective view of an example of a moving robot 100; FIG. 2 is a plan view of the moving robot 100 illustrated in FIG. 1; and FIG. 3 is a side view of the moving robot 100 illustrated in FIG. 1.

In the following description, the moving robot and a cleaner capable of moving autonomously may be used to represent the same meaning. Further, in the following description, a plurality of cleaners may include at least some of the components illustrated in FIGS. 1 to 3.

Referring to FIGS. 1 to 3, a moving robot 100*a* cleans the floor while moving by itself in a predetermined area. Here, the cleaning of the floor includes suctioning dust (including foreign matter) from the floor or mopping the floor. Specifically, the moving robot 100*a* may include a dry robot cleaner suctioning dust.

The moving robot 100*a* may include a cleaner body 110, a cleaning unit 120, a sensing unit 130, and a dust container 140. Various components, including a controller 1800 for controlling the moving robot 100*a*, may be embedded or mounted in the cleaner body 110. In addition, the cleaner body 110 is equipped with a wheel unit 111 to allow the moving robot 100*a* to travel. By the wheel unit 111, the moving robot 110*a* may move in all directions or may rotate.

Referring to FIG. 3, the wheel unit 111 includes main wheels 111*a* and a sub-wheel 111*b*.

The main wheels 111*a* are provided on both sides of the cleaner body 110 to be rotated in one direction or the other direction according to a control signal of the controller. The respective main wheels 111*a* may be configured to be driven independently from each other. For example, the main wheels 111*a* may be driven by different driving motors. Alternatively, the main wheels 111*a* may be driven by a plurality of different shafts of one motor.

The sub-wheel 111*b* supports the cleaner body 110 together with the main wheels 111*a* and is configured to assist in traveling of the moving robot 100*a*. The sub-wheel 111*b* may also be provided in the cleaning unit 120 which will be described later.

As the controller controls driving of the wheel unit 111, the moving robot 100*a* may travel autonomously on the floor.

A battery (not shown) for supplying power to the moving robot 100*a* may be mounted in the cleaner body 110. The battery is rechargeable and may be detachably mounted on a bottom surface of the cleaner body 110.

In FIG. 1, the cleaning unit 120 protrudes from one side of the cleaner body 110 to suction air containing dust or to mop the floor. The one side may be a side of the cleaner body 110 traveling in a forward direction F, i.e., the front side of the cleaner body 110.

In this embodiment of FIG. 1, the cleaning unit 120 protrudes from one side of the cleaner body 110 in the front direction and both the left and right directions. Specifically, a front end portion of the cleaning unit 120 is disposed at a position spaced apart forward from the one side of the cleaner body 110, and both left and right end portions thereof are disposed at positions spaced apart leftward and rightward, respectively, from the one side of the cleaner body 110.

As the cleaner body 110 is formed in a circular shape, and both sides of a rear end portion of the cleaning unit 120 protrude leftward and rightward, respectively, from the cleaner body 110, empty spaces, i.e., gaps may be formed between the cleaner body 110 and the cleaning unit 120. The empty spaces are spaces between both left and right end portions of the cleaner body 110, and both left and right end portions of the cleaning unit 120, and may be recessed inward of the moving robot 110*a*.

In the case where an obstacle is stuck in the empty spaces, a problem may occur in that the moving robot 100*a* may be caught by the obstacle and is unable to move. In order to prevent this problem, a cover member 129 may be provided to cover at least a portion of the empty space.

The cover member 129 may be provided for the cleaner body 110 or the cleaning unit 120. In this embodiment, the cover member 129 may protrude from each of both sides of the rear end portion of the cleaning unit 120, to cover an outer circumferential surface of the cleaner body 110.

The cover member 129 is provided to fill the empty spaces, i.e., at least a portion of the empty spaces between the cleaner body 110 and the cleaning unit 120. Accordingly, the cover member 129 may prevent an obstacle from being stuck in the empty spaces; or even when the obstacle is stuck in the empty spaces, the cover member 129 may allow the moving robot 100*a* to easily escape from the obstacle.

The cover member 129, protruding from the cleaning unit 120, may be supported by the outer circumferential surface of the cleaner body 110. When the cover member 129 protrudes from the cleaner body 110, the cover member 129 may be supported by a rear surface of the cleaning unit 120. In this structure, when the cleaning unit 120 collides with an obstacle and is affected by the collision, impact from the collision may be partially transferred to the cleaner body 110, thereby distributing the force of impact.

The cleaning unit 120 may be detachably coupled to the cleaner body 110. When the cleaning unit 120 is separated from the cleaner body 110, a mop module (not shown) may be detachably coupled to the cleaner body 110 to replace the separated cleaning unit 120.

Accordingly, if wishing to remove dust from the floor, a user may install the cleaning unit 120 to the cleaner body 110, and if wishing to mop the floor, the user may install the mop module to the cleaner body 110.

In this embodiment, a liquid sensor for specifying a wet contaminated region may be further included. The liquid sensor may be disposed at a lower front end of the cleaning unit 120 and may prevent liquid from being suctioned and may rapidly detect liquid, thereby preventing the cleaner body 110 from moving on the liquid surface.

The liquid sensor may include various components for specifying the wet contaminated region. For example, the liquid sensor may include a humidity sensor. A resistive humidity sensor or a capacitive humidity sensor may be used as the humidity sensor.

In another example, the liquid sensor may specify the wet contaminated region by using a sensing portion (not shown) having an electric resistance which changes upon contact with water. The sensing portion of the liquid sensor is desirably disposed at the lower front end of the cleaning unit 120.

In yet another example, the liquid sensor may include a resistance wire and a conductive wire and may sense a short circuit occurring in the resistance wire or the conductive wire due to conductivity of the liquid.

When the cleaning unit 120 is mounted in the cleaner body 110, the mounting may be guided by the cover member 129. That is, as the cover member 129 is disposed to cover the outer circumferential surface of the cleaner body 110, a relative position of the cleaning unit 120 with respect to the cleaner body 110 may be determined.

The cleaning unit 120 may include a castor 123. The castor 123 may assist in traveling of the moving robot 100*a* and may support the moving robot 100*a*. The sensing unit 130 is disposed at the cleaner body 110. As described above, the sensing unit 130 may be disposed at one side of the cleaner body 110, i.e., at the front side, where the cleaning unit 120 is disposed.

For example, the cleaning unit 120 may include a sweeping unit 120 rotating about a rotation axis to sweep the floor, and a motor (not shown) providing torque to the sweeping unit 120.

The sensing unit 130 may be disposed to overlap the cleaning unit 120 in a vertical direction of the cleaner body 110. The sensing unit 130 may be disposed above the cleaning unit 120, to detect a front obstacle, terrain features, or the like so that the cleaning unit 120, disposed at a foremost portion of the moving robot 100*a*, may not collide with the obstacle.

The sensing unit 130 may be configured to perform other sensing functions, in addition to the aforementioned sensing function. For example, the sensing unit 130 may include a camera 131 for capturing images of the surroundings. The camera 131 may include a lens and an image sensor. In addition, the camera 131 may convert the image of the surroundings of the cleaner body 110 into an electrical signal to be processed by the controller 1800, and may transmit an electrical signal, e.g., corresponding to an upward image, to the controller 1800. The electrical signal corresponding to the upward image may be used to detect a position of the cleaner body 110.

Further, the sensing unit 130 may detect an obstacle such as wall, furniture, cliff, and the like located on a traveling surface or on a traveling path. In addition, the sensing unit 130 may detect the presence of a docking device for charging the battery. Moreover, by detecting ceiling information, the sensing unit 130 may map an area or a region to be cleaned of the moving robot 100*a*. Furthermore, the sensing unit 130 may acquire a floor image surrounding the cleaner body 110.

A dust container 140 for separating dust from the suctioned air and collecting the separated dust may be detachably coupled to the cleaner body 110. In addition, the dust container 140 is provided with a dust container cover 150 covering the dust container 140. In one embodiment, the dust container cover 150 may be hingedly coupled to the cleaner body 110 to be rotatable. The dust container cover 150 may be fixed to the dust container 140 or the cleaner body 110 to remain covering a top surface of the dust container 140. When the dust container cover 150 is disposed to cover the top surface of the dust container 140, the dust container cover 150 may prevent the dust container 140 from being separated from the cleaner body 110.

A portion of the dust container 140 is received in a dust container receiving part 113, and another portion of the dust container 140 protrudes rearward (i.e., a reverse direction R opposite the forward direction F) of the cleaner body 110.

The dust container 140 may have an inlet, through which air containing dust is sucked, and an outlet through which air separated from the dust is discharged. When the dust container 140 is mounted at the cleaner body 110, the inlet and outlet may communicate with each other through an opening 155 formed at an inner wall of the cleaner body 110, thereby forming an intake passage and an exhaust passage in the cleaner body 110.

Based on this connection relationship, air containing dust, which is introduced into the cleaning unit 120, passes through the intake passage in the cleaner body 110 to be introduced into the dust container 140, and the air and dust may be separated from each other by passing through a filter or a cyclone provided in the dust container 140. The dust is collected in the dust container 140. After being discharged from the dust container 140, the air passes through the exhaust passage in the cleaner body 110 to be finally discharged to the outside through an exhaust port 112.

An example relevant to components of the moving robot 100*a* will be described below with reference to FIG. 4.

The moving robot 100*a* according to an embodiment of the present disclosure may include at least one or a combination of a communicator 1100, an input unit 1200, a travelling unit 1300, a sensing unit 1400, an output unit 1500, a power supply unit 1600, a memory 1700, a controller 1800, and a cleaning unit 1900.

In this case, not all components illustrated in FIG. 4 are essential components of the moving robot 100*a*, and the moving robot 100*a* may be implemented using more or fewer components than the illustrated components. Further, as described above, among the components, which will be described below and included in a plurality of moving robots described in the present disclosure, only some components are the same. That is, the plurality of moving robots may include different components.

The above components will be described below. First, the power supply unit 1600 includes a battery which may be charged by an external commercial power source and supplies power to the moving robot. The power supply unit 1600 may supply driving power to the respective components included in the moving robot and may supply operating power required for the moving robot to travel or perform a specific function.

In this case, the controller 1800 may detect a remaining battery capacity of the battery, and if the remaining battery capacity is insufficient, the controller 1800 controls the moving robot to move to a charging station connected to the external commercial power source and to charge the battery by receiving a charging current from the charging station. The battery may be connected to a battery sensor such that the remaining battery capacity and a state of charge may be transmitted to the controller 1800. The controller 1800 may control the output unit 1500 to display the remaining battery capacity on the output unit 1500.

The battery may be positioned at a lower portion of the center of the moving robot or may be positioned on any one of the left and right sides of the moving robot. In the latter case, the moving robot may further include a balance weight to resolve bias in weight of the battery.

The controller 1800 may process information based on artificial intelligence (AI) technology and may include one or more modules for performing at least one of learning of information, inference of information, perception of information, and processing of a natural language.

By using machine learning technology, the controller 1800 may execute at least one of learning, inference, and processing of vast amounts of information (big data), such as information stored in the cleaner, surrounding environment information related to a mobile terminal, information stored in an external storage which is communicably connected, and the like.

In addition, the controller 1800 may predict (or infer) at least one executable operation of a cleaner based on information learned using machine learning technology and may control the cleaner to execute the most feasible operation among the at least one or more predicted operations. The machine learning technology refers to technology that collects and learns a large amount of information based on at least one algorithm, and judges and predicts information based on the learned information.

The learning of information is an operation of identifying characteristics of information, rules, and judgment criteria, quantifying a relationship between information and information, and predicting new data by using the quantified pattern.

Algorithms used in the machine learning technology may be algorithms based on statistics, and examples thereof may include a decision tree that uses a tree-like structure as a predictive model, an artificial neural network that mimics human neural network structures and functions of living creatures, genetic programming based on biological evolutionary algorithms, clustering of distributing observed examples into a subset of clusters, a Monte Carlo method of computing function values as probability using randomly-extracted random numbers, and the like.

As one field of the machine learning technology, deep learning is technology for performing at least one of learning, judging, and processing of information by using the artificial neural network algorithm (Deep Neural Network (DNN)). The artificial neural network (ANN) may have a structure of linking layers and transferring data between the layers. This deep learning technology may be employed to learn vast amounts of information through the artificial neural network using a graphic processing unit (GPU) optimized for parallel computing.

The control unit 1800 may use training data stored in an external server or a memory and may include a learning engine mounted to detect characteristics for recognizing a predetermined object. At this time, the characteristics for recognizing the object may include the size, shape and shade of objects.

Specifically, when the control unit 1800 inputs some images, acquired by the camera provided on the cleaner, into the learning engine, the learning engine may recognize at least one object or living creature included in the input images. More specifically, the control unit 1800 may recognize an artificial mark, among the things recognized as objects, by various methods.

As described above, when the learning engine is applied to traveling of the cleaner, the control unit 1800 can recognize whether an obstacle, such as a chair leg, a fan, and a balcony gap of a specific shape, which obstruct the running of the cleaner, exists around the cleaner, thereby enhancing efficiency and reliability in the traveling of the cleaner.

Furthermore, the learning engine may be embedded in the controller 1800 or in an external server. In the case where the learning engine is embedded in the external server, the controller 1800 may control the communicator 1100 to transmit at least one image to be analyzed to the external server.

The external server may input the image transmitted from the cleaner into the learning engine and may recognize at least one object or living creature included in the image. In addition, the external server may transmit information related to the recognition result back to the cleaner. In this case, the information related to the recognition result may include information related to the number of objects included in the image to be analyzed and a name of each object.

In addition, the travelling unit 1300 may include a motor, and may drive the motor to bidirectionally rotate the left and right main wheels, so that the main body may rotate or move. In this case, the left and right main wheels may be independently moved. The travelling unit 1300 may allow the main body of the moving robot to move in all directions or in a curved path, or to rotate in place.

In addition, the input unit 1200 receives various control commands for controlling the moving robot from a user. The input unit 1200 may include one or more buttons, and may include, for example, an OK button, a setting button, and the like. The OK button is a button for receiving a command for confirming detection information, obstacle information, position information, and map information from the user, and the setting button is a button for receiving a command for setting those types of information from the user.

Further, the input unit 1200 may include an input reset button for canceling a previous user input and receiving a new user input, a delete button for deleting a preset user input, a button for setting or changing an operation mode, a button for receiving an input to return to the charging station.

In addition, the input unit 1200 may be implemented as a hard key, a soft key, a touch pad, or the like and may be disposed on a top portion of the moving robot. For example, the input unit 1200 may be implemented in the form of a touch screen together with the output unit 1500.

The output unit 1500 may be installed on a top portion of the moving robot, and an installation location and an installation type may vary. For example, the output unit 1500 may display a state of battery, a traveling mode, or the like on a screen.

The output unit 1500 may output internal status information of the moving robot which is detected by the sensing unit 1400. For example, a current status of each component included in the moving robot may be output. Further, the output unit 1500 may also display external status information, obstacle information, position information, map information, and the like, which are detected by the sensing unit 1400, on the screen.

The output unit 1500 may be configured as any one of a light emitting diode (LED), a liquid crystal display (LCD), a plasma display panel, and an organic light emitting diode (OLED).

In this case, the output unit 1500 may further include an audio output module for audibly outputting information related to an operation of the moving robot executed by the control unit 1800 or an operation result. For example, the output unit 1500 may output a warning sound to the outside in response to a warning signal generated by the control unit 1800.

In this case, the audio output module (not shown) may be a sound output means, such as a beeper, a speaker and the like, and the output unit 1500 may output sounds to the outside through the audio output module using audio data or message data having a predetermined pattern and stored in the memory 1700.

Accordingly, the moving robot according to an embodiment of the present invention may output environment information related to a travelling area on a screen or output the information as a sound through the output unit 1500. According to another embodiment, the moving robot may transmit map information or environment information to a terminal device through the communication unit 1100 so that the terminal device may output a screen or a sound to be output through the output unit 1500.

The memory 1700 stores a control program for controlling or driving the moving robot and data corresponding thereto. The memory 1700 may store audio information, image information, obstacle information, position information, map information, and the like. Also, the memory 1700 may store information related to a traveling pattern.

As the memory 1700, a non-volatile memory may be commonly used. Here, the non-volatile memory (NVM or NVRAM) is a storage device capable of continuously maintaining stored information even when power is not supplied. For examples, the memory 1700 may be a ROM, a flash memory, a magnetic computer storage device (e.g., a hard disk, a diskette drive, a magnetic tape), an optical disk drive, a magnetic RAM, a PRAM, and the like.

The sensing unit 1400 may include at least one of an external signal sensor, a front sensor, a cliff sensor, a two-dimensional (2D) camera sensor, a liquid sensor, a dust sensor, a floor image sensor, a gyro sensor, an acceleration sensor, a sweeping load sensor 1440, and a three-dimensional (3D) camera sensor.

The external signal sensor may sense an external signal of the moving robot. The external signal sensor may be, for example, an infrared ray (IR) sensor, an ultrasonic sensor, a radio frequency (RF) sensor, and the like.

The moving robot may detect a position and direction of the charging station by receiving a guide signal generated by the charging station using the external signal sensor. In this case, the charging station may transmit the guide signal indicating a direction and a distance so that the moving robot may return. That is, by receiving a signal transmitted from the charging station, the moving robot may determine a current position and may set a moving direction to return to the charging station.

The front sensor may be installed at predetermined intervals on the front side of the moving robot, specifically along an outer circumferential surface of a side surface of the moving robot. The front sensor is located on at least one side surface of the moving robot to detect an obstacle in front of the moving robot. The front sensor may detect an object, particularly an obstacle, existing in a moving direction of the moving robot and transmit detection information to the controller 1800. That is, the front sensor may detect protrusions in the moving path of the moving robot, furnishings, furniture, wall surfaces, wall corners, and the like, and transmit the information to the controller 1800.

The front sensor may be, for example, an infrared ray (IR) sensor, an ultrasonic sensor, an RF sensor, a geomagnetic sensor, or the like, and the moving robot may use one type of sensor as the front sensor, or a combination of two or more types of sensors as the front sensor if necessary.

For example, an ultrasonic sensor may be generally used to detect a remote obstacle. The ultrasonic sensor may be provided with a transmitter and a receiver. The controller 1800 may determine the presence of an obstacle based on whether ultrasonic waves radiated from the transmitter are reflected from an obstacle or the like and then received by the receiver, and may calculate a distance from the obstacle by using an ultrasonic wave radiation time and an ultrasonic wave reception time.

Also, the controller 1800 may detect information related to a size of an obstacle by comparing ultrasonic waves radiated from the transmitter with ultrasonic waves received by the receiver. For example, the controller 1800 may determine that the obstacle is larger in size when more ultrasonic waves are received in the receiver.

In one embodiment, a plurality of (e.g., five) ultrasonic sensors may be installed along an outer circumferential surface on the front side surface of the moving robot. In this case, it is preferred that the transmitters and the receivers of the ultrasonic sensors may be installed alternately on the front surface of the moving robot.

That is, the transmitters may be disposed on the left and right sides spaced apart from the center of the front surface of the main body of the moving robot; and one or two or more transmitters may be disposed between the receivers to form a reception region of an ultrasonic signal reflected from the obstacle, or the like. With this arrangement, the reception region may be expanded, while reducing the number of sensors. A transmission angle of ultrasonic waves may be maintained in a range which does not affect other signals so as to prevent a crosstalk. Also, reception sensitivity of the receivers may be set differently.

In addition, the ultrasonic sensor may be installed upwardly at a predetermined angle so that the ultrasonic waves generated by the ultrasonic sensors are output upwardly. In this case, the ultrasonic sensor may further include a predetermined blocking member to prevent the ultrasonic waves from being radiated downwardly.

As described above, two or more types of sensors may be used as the front sensors, such that any one of an IR sensor, an ultrasonic sensor, an RF sensor and the like may be used as the front sensor.

For example, the front sensor may include an IR sensor as a different type of sensor, in addition to the ultrasonic sensor. The IR sensor may be installed on the outer circumferential surface of the moving robot together with the ultrasonic sensor. The IR sensor may also detect an obstacle existing on a front side or a side surface of the moving robot, and may transmit obstacle information to the controller 1800. That is, the IR sensor senses a protrusion, furnishings, furniture, a wall surface, a wall corner, and the like, existing in the moving path of the moving robot, and transmits detection information to the controller 1800. Therefore, the moving robot may move within a specific area without collision with an obstacle.

Further, by using various types of optical sensors, a cliff detection sensor (or a cliff sensor) may detect an obstacle on the floor supporting the main body of the moving robot. That is, the cliff sensor may be installed on a rear surface of the moving robot, and may also be installed at different positions depending on a type of the moving robot.

The cliff sensor is located on the rear surface of the moving robot and detects an obstacle on the floor. The cliff sensor may be an IR sensor, an ultrasonic sensor, an RF sensor, a Position Sensitive Detector (PSD) sensor, and the like, including a light emitter and a light receiver as in the case of the obstacle detection sensor.

For example, any one of the cliff sensors may be installed on the front side of the moving robot, and the other two cliff sensors may be installed on a relatively rear side thereof. For example, the cliff sensor may be a PSD sensor, but may also include a plurality of different types of sensors.

The PSD sensor detects the positions of short/long distances of incident light at a single p-n junction by using the surface resistance of a semiconductor. The PSD sensor may include a 1D PSD sensor that detects light on a single axis and a 2D PSD sensor that may detect the position of light on the surface, and each may have a pin photodiode structure. The PSD sensor may be a type of infrared sensor which transmits an infrared ray to an obstacle and measures an angle between the infrared ray transmitted to the obstacle and infrared ray returning after being reflected from the obstacle, thus measuring a distance therebetween. That is, the PSD sensor may calculate a distance from the obstacle using triangulation.

The PSD sensor includes a light emitter emitting infrared light to an obstacle and a light receiver receiving infrared light returning after being reflected from the obstacle. Generally, the PSD sensor is implemented as a module. When an obstacle is detected by using the PSD sensor, a stable measurement value may be obtained regardless of a difference in reflectivity or color of the obstacle.

The cleaning unit 1900 may clean a designated area according to a control command transmitted from the controller 1800. The cleaning unit 1900 may scatter surrounding dust by using a brush (not shown) for scattering dust in the designated area to be cleaned, and then may suction the scattered dust by driving a suction fan and a suction motor. In addition, the cleaning unit 1900 may mop the designated area to be cleaned by changing components.

Further, the controller 1800 may measure an angle between an infrared light emitting signal emitted by the cliff detection sensor toward the floor and a reflection signal received after being reflected from the obstacle, so as to detect a cliff and analyze a depth of the cliff.

Meanwhile, the controller 1800 may determine whether to pass through a cliff according to a floor state of the cliff detected by using the cliff detection sensor, and may determine whether to pass through the cliff based on the determination. For example, the controller 1800 may determine the presence and depth of a cliff by using the cliff sensor, and only when a reflection signal is detected by the cliff sensor, the controller 1800 allows the moving robot to pass through the cliff. In another example, by using the cliff sensor, the controller 1800 may also determine whether the moving robot is lifted.

The two-dimensional camera sensor is provided on one surface of the moving robot to acquire image information related to the surroundings of the main body of the moving robot during movement. An optical flow sensor converts a downward image input from an image sensor provided in the sensor to generate image data in a predetermined format. The generated image data may be stored in the memory 1700.

Also, at least one light source may be installed adjacent to the optical flow sensor. The at least one light source emits light to a predetermined area of the floor surface, which is captured by the image sensor. That is, while the moving robot moves in a specific area along the floor surface, a predetermined distance is maintained between the image sensor and the floor surface when the floor surface is flat.

By contrast, when the moving robot moves on an uneven floor surface, the image sensor and the floor surface are spaced apart from each other by a predetermined distance or more due to an unevenness and an obstacle on the floor surface. In this case, the at least one light source may be controlled by the controller 1800 to adjust an amount of light to be emitted. The light source may be a light emitting device, for example, a light emitting diode (LED), which is capable of adjusting an amount of light.

By using the optical flow sensor, the controller 1800 may detect a position of the moving robot regardless of sliding of the moving robot. By comparing and analyzing image data captured by the optical flow sensor according to elapsed time, the controller 1800 may calculate a moving distance and a moving direction, and may calculate a position of the moving robot based on the calculated moving distance and moving direction. By using downward image information of the moving robot which is captured using the optical flow sensor, the controller 1800 may perform correction resistant to sliding with respect to the position of the moving robot calculated by other means.

The three-dimensional (3D) camera sensor may be attached to one surface or a portion of the main body of the moving robot to generate 3D coordinate information related to the surroundings of the main body of the moving robot. That is, the 3D camera sensor may be a 3D depth camera that calculates a remote/near distance between the moving robot and an object to be captured.

Specifically, the 3D camera sensor may capture 2D images related to the surroundings of the main body, and may generate a plurality of 3D coordinate information corresponding to the captured 2D images.

In one embodiment, the 3D camera sensor may be implemented with a stereo vision method using two or more existing cameras for acquiring 2D images, to generate 3D coordinate information by combining two or more images acquired by the two or more cameras.

Specifically, the 3D camera sensor according to the embodiment may include a first pattern emitter for downwardly emitting light in a first pattern to the front side of the main body, a second pattern emitter for upwardly emitting light in a second pattern to the front side of the main body, and an image acquirer for acquiring a front image of the main body. Thus, the image acquirer may acquire an image of an area on which the light of the first pattern and the light of the second pattern are incident.

In another embodiment, in addition to a single camera, the 3D camera sensor may include an infrared pattern emitter for emitting an infrared pattern, and may capture a shape obtained by projecting the infrared pattern emitted from the infrared pattern emitter onto an object to be captured, so as to measure a distance between the 3D camera sensor and the object to be captured. The 3D camera sensor may be an infrared (IR) 3D camera sensor.

In yet another embodiment, in addition to a single camera, the 3D camera sensor may include a light emitter for emitting light. The 3D camera sensor may receive a portion of laser light, which is emitted from the light emitter and reflected from an object to be captured, and may analyze the received light, so as to measure a distance between the 3D camera sensor and the object to be captured. The 3D camera sensor may be a time-of-flight (TOF) 3D camera sensor.

Specifically, the 3D camera sensor is configured to emit a laser beam extending in at least one direction. For example, the 3D camera sensor may be provided with first and second laser emitters. The first laser emitter emits linear laser beams intersecting each other, and the second laser emitter emits single linear laser beam. In this embodiment, the lowermost laser is used to detect an obstacle on the floor, the uppermost laser is used to detect an obstacle at a top portion, and an intermediate laser between the lowermost laser and the uppermost laser is used to detect an obstacle at a middle portion.

The dust sensor may measure the concentration of dust in the air suctioned by the cleaning unit. The dust sensor may include an optical sensor and the like.

The floor image sensor may be a camera for capturing images of the floor around the main body. The floor image sensor may be installed at a front end of the cleaning unit 120, or may be provided as part of the sensing unit 130 installed at the front end of the main body.

The sweeping load sensor 1440 measures a load of the sweeping unit 120. Specifically, the sweeping load sensor 1440 may measure a load of a motor coupled to the sweeping unit 120.

The communicator 1100 is connected to a terminal device and/or another device (hereinafter also referred to as a "home appliance") through one communication method among wired, wireless, and satellite communications, so as to transmit and receive signals and data.

The communicator 1100 may transmit and receive data with another device located in a specific area. In this case, another device may be any device as long as the device may transmit and receive data through a network. For example, another device may be an air conditioner, a heating device, an air purifier, a lamp, a TV, a vehicle, and the like. Another device may also be a device for controlling a door, a window, a water supply valve, a gas valve, or the like. Further, another device may also be a sensor for detecting temperature, humidity, air pressure, gas, or the like.

In addition, the communicator 1100 may communicate with another moving robot 100 located in a specific area or within a predetermined range.

The sensing unit 1400 may include a slope information obtainer (not shown) for obtaining information on a slope of the body relative to the floor. For example, the slope information obtainer may include a gyro sensor. The slope information obtainer may include a processing module (not shown) for converting a signal sensed by the gyro sensor into slope information. The processing module may be included as part of the controller 1800 and may be implemented as an algorithm or a program. In another example, the slope information obtainer may include a magnetic field sensor to obtain slope information based on the earth's magnetic field sensing information.

Here, the floor refers to a horizontal plane, which is a plane perpendicular to the direction of gravity. The gyro sensor may obtain information on a rotation angular velocity with respect to the horizontal plane of the body 30. Specifically, the gyro sensor may sense the rotation angular velocity with respect to the X and Y axes which are parallel to the horizontal plane and perpendicular to each other. By combining the rotation angular velocity (roll) for the X axis and the rotation angular velocity (pitch) for the Y axis using the processing module, the rotation angular velocity for the horizontal plane may be calculated. By integrating the rotation angular velocity using the processing module, a slope value may be calculated.

The gyro sensor may detect a predetermined reference position. The slope information obtainer may obtain slope information based on the reference direction.

The gyro sensor may have a gyro sensing function for three axes, perpendicular to each other, in a spatial coordinate system. Information collected by the gyro sensor may be roll, pitch, and yaw information. The processing module may calculate a direction angle of the moving robot 100*a* by integrating angular velocities of roll, pitch, and yaw.

The gyro sensor is desirably disposed at the body. Accordingly, the gyro sensor is disposed in a remaining part Q, which will be described later, in the body 30. In addition, the slope information obtainer is disposed in the remaining part Q.

The gyro sensor may be implemented as a separate sensor or as part of an IMU sensor which will be described below.

The sensing unit 1400 may include a magnetic field sensor for sensing the magnetic field. The magnetic field sensor may have a magnetic sensing function for the three axes, perpendicular to each other, in the spatial coordinate system. The magnetic field sensor may measure a direction angle (azimuth). The magnetic field sensor may be implemented as a separate sensor or as part of the IMU sensor which will be described below.

The sensing unit 1400 may include an acceleration sensor installed at the body 30 and configured to sense the acceleration of the moving robot 100*a*. The acceleration sensor may have an acceleration sensing function for the three axes, perpendicular to each other, in the spatial coordinate system. The acceleration sensor may be implemented as a separate sensor or as part of the IMU sensor which will be described below.

The moving robot 100*a* may include an inertial sensor unit (IMU) (not shown). The moving robot 100*a* may stabilize a traveling motion based on information of the IMU. The IMU may have the functions of the gyro sensor, the magnetic field sensor, and the acceleration sensor.

The moving robot 100*a* may determine in advance whether a material of the floor (including a floor obstacle which the moving robot may climb) is a dangerous material, and may specify a region, determined as a dangerous material, as a sub-region. In addition, the moving robot 100*a* (first moving robot) may measure the height of an obstacle by using various sensors (a laser sensor, an infrared sensor, and an image sensor), and may specify a region, which a wet-type moving robot (second moving robot) may not climb up due to the height of an obstacle, and a region, which is closed by the unclimbable obstacle, as the sub-regions. The sub-region includes regions which the wet-type moving robot may not enter and is difficult to clean.

As will be described later, the moving robot 100*a* may receive information on the sub-regions from another moving robot 100*b* or a server.

The controller 1800 may sense the sub-region within a travelling area based on information input by at least one of the optical flow sensor, the acceleration sensor, the cliff sensor, and the sweeping load sensor 1440.

The controller 1800 may determine the sub-region within the travelling area by independently or comprehensively considering information input by the optical flow sensor, the acceleration sensor, the cliff sensor, and the sweeping load sensor 1440.

The controller 1800 may determine a floor material based on downward image information acquired by the optical flow sensor, and if the floor material is a dangerous material, the controller 1800 may set a current position (or current position and a surrounding area thereof) as the sub-region.

Specifically, the controller 1800 may calculate at least one of a reflectance value of the floor, an image quality value of the downward image, and a frame rate of the downward image based on the downward image information; and if at least one of the following conditions 1, 2, and 3 is satisfied, the controller 1800 may determine a floor material to be a dangerous material.

Condition 1

An image quality value is less than a predetermined reference quality value.

Condition 2

A frame rate is less than a predetermined reference frame rate.

Condition 3

A reflectance value of the floor is less than a predetermined reflectance value.

In another example, the controller 1800 may calculate an image quality value of the downward image based on the downward image information; and if the image quality value is less than the predetermined reference image quality value, the controller 1800 may determine that a floor material is a dangerous material.

In yet another example, the controller 1800 may calculate a frame rate of the downward image based on the downward image information; and if the frame rate is less than the predetermined reference frame rate, the controller 1800 may determine that a floor material is a dangerous material.

In still another example, the controller 1800 may calculate a reflectance value of the floor based on the downward image information; and if the reflectance value of the floor is less than the predetermined reference reflectance value, the controller 1800 may determine that a floor material is a dangerous material.

Here, the image quality value is defined as a value obtained by quantifying a state of the downward image captured by the optical flow sensor 23*b*.

The image quality value may be determined based on a shape of an image formed on the floor by light emitted from a light source. That is, the light source emits a planar light beam of a predetermined shape onto the floor, and a degree of similarity to the shape of the planar light, emitted from the light source, in the captured downward image is defined as the image quality value.

In another example, a process of measuring an image quality may be a process of measuring suitability of a contrast ratio after an equalization process with a histogram.

The image quality measuring process may include a binarization process and the process of measuring suitability of a contrast ratio.

The equalization process may be a process for improving a recognition rate of the downward image by histogram analysis. The acquired downward image may include a plurality of pixels. The histogram shows a distribution of gray level values of the plurality of pixels included in the downward image. That is, the histogram indicates a distribution of light and shade portions distributed in the downward image. Specifically, in a 256-gray level image, gray level values range from 0 to 255. The histogram shows a frequency of the gray level values of the respective pixels in a bar graph. The equalization process is a process of equalizing the distribution of gray level values if the gray level values are biased to one side or are non-uniformly distributed. That is, the equalization process is a process of distributing the gray level values, concentrated on one side, to achieve a uniform distribution of the values. By the equalization process, shade portions of the downward image become brighter, and light portions thereof become darker, such that the respective pixels may have appropriate gray level values.

The binarization process is a process of dividing the respective pixels, included in the downward image, into black or white regions, after the equalization process. The downward image, after the equalization process, may have complex shades, such that the respective pixels may be binarized to either black or white by the binarization process. In order to divide the pixels into black or white in the binarization process, a threshold value is required. The threshold value may be a set value for dividing the pixels into black or white. If the gray level value of a pixel is greater than the threshold value, the pixel may be binarized to 0 (black); and if the gray level value of a pixel is less than the threshold value, the pixel may be binarized to 1 (white).

A process of determining suitability of a contrast ratio may be a process of determining whether the contrast ratio of the binarized pixels satisfies a predetermined ratio.

If a ratio of black pixels is relatively high, a low image quality value is obtained; and if the image quality value is low, the floor may have high roughness or may be a carpet. Accordingly, in the present disclosure, if the image quality value is less than the reference image quality value, the floor material is determined to be a dangerous material.

In addition, reflectance of the floor may be a value obtained by dividing the white pixels by the black pixels. In another example, reflectance of the floor may be defined as a quantity of light emitted by the light source, reflected from the floor, and incident on a light receiver (not shown).

In the case of a wood floor, a marble floor, or a linoleum floor which has high reflectance and is a flat material, an image quality value of the downward image is high, with high floor reflectance and a high frame rate. However, if a floor material has low reflectance or has high roughness, an image quality value of the downward image is low, with low floor reflectance and a low frame rate.

Accordingly, in the present disclosure, a floor material is determined based on a difference in a plurality of parameters of the downward image acquired by the optical flow sensor, the moving robot may avoid a dangerous area before entering. Particularly, as the plurality of parameters may be verified by cross-validation or independent validation by using one sensor, a floor material may be determined accurately.

Therefore, by determining that an area having low reflectance is a carpet area, the moving robot may avoid the area while traveling. In this manner, a problem that the moving robot is difficult to escape from the carpet may be solved, which occurs when the moving robot receiving a driving force by rotation of a mop moves into the carpet.

In another example, the controller 1800 may determine a floor material based on a distance from the floor, obtained by the cliff sensor, and the downward image information acquired by the optical flow sensor.

Specifically, if a value of the distance from the floor, obtained by the cliff sensor, is less than a reference distance value, the control unit 10 may control a sweeping motor to perform an entry restriction operation. In this case, the control unit 10 may determine a floor material based on the downward image information acquired by the optical flow sensor.

If a value of the distance from the floor, obtained by the cliff sensor, is greater than the reference distance value and less than a maximum value, the control unit 10 may control the sweeping motor to allow the moving robot to travel normally.

The cliff sensor is disposed at a front end of the body and detects a stepped part between a floor (reference floor), being in contact with a spin mop, and the floor below the front end of the body. Based on the value detected by the cliff sensor, a cliff may be detected, and a floor higher than the reference floor may be detected. If a floor is higher than the reference floor, the moving robot determines that a carpet is laid on the floor and may avoid the carpet.

By using a plurality of measurement means of the cliff sensor and the optical flow sensor, an error in determining the floor material may be reduced.

In yet another example, while a portion of the spin mop enters a dangerous area, the moving robot may also determine whether a current position is in a dangerous area.

The control unit 10 may control the moving robot 1 based on a mop load value sensed by the sweeping load sensor 1440. Specifically, if a mop load value, sensed by the sweeping load sensor 1440, is greater than a predetermined reference load value, the control unit 10 may control the sweeping motor 61 to perform an entry restriction operation.

In addition, if a mop load value, sensed by the sweeping load sensor 1440, is less than the predetermined reference load value, the control unit 10 may control the sweeping motor 61 to travel normally.

In still another example, the control unit 10 may calculate an average acceleration value from the acceleration values; and if the average acceleration value is greater than a reference average acceleration value, the control unit 10 may control the sweeping motor 61 to perform an entry restriction operation. Further, the control unit 10 may calculate dispersion of acceleration values; and if the dispersion is greater than a reference dispersion, the control unit 10 may control the sweeping motor 61 to perform an entry restriction operation.

Furthermore, if the average acceleration value is greater than a reference average acceleration value, the control unit 10 may control the sweeping motor 61 to travel normally. In addition, if the dispersion is less than the reference dispersion, the control unit 10 may control the sweeping motor 61 to travel normally.

Accordingly, in the present disclosure, even when a dangerous area may not be detected in advance by the cliff sensor and the optical flow sensor, the moving robot may determine a dangerous area at an early stage after entering the dangerous area, based on a plurality of factors or a single factor, such as the load of the spin mop, information obtained by the acceleration sensor, and the like.

In addition, based on various motions of the moving robot, such as rotation, forward movement, etc., it is possible to rapidly determine a portion of the moving robot stuck in the carpet and the like, such that the moving robot may rapidly escape from the place.

In still another example, if at least one of the following conditions 4 to 7 is satisfied, the control unit 10 may specify the region as having a dangerous material.

Condition 4

A load value of the sweeping motor is greater than a predetermined reference load value.

Condition 5

A value of a distance from the floor is less than a reference distance value.

Condition 6

An average acceleration value is greater than a reference average acceleration value.

Condition 7

An acceleration dispersion value is greater than a reference dispersion value

In still another example, if at least one of the above conditions 1 to 7 is satisfied, the controller 1800 may specify the location as a sub-region.

Based on information input by the image sensor, the controller 1800 may specify a traveling area, may divide the travelling area into at least one or more first and second regions, and may specify sub-regions. In the case where a sub-region is located in the first area, the controller 1800 controls a travelling unit and a cleaning unit to clean the first region except the sub-region, to start to clean the second region, and then to clean the sub-region in the first region upon finishing cleaning the second region.

The controller 1800 may transmit position information of a region, in which a wet-type cleaning is unable to be performed, to a second moving robot 100*b* which performs cleaning in a different manner from the first moving robot 100*a*. Upon receiving information that cleaning of the first region is complete from the second moving robot 100*b*, the controller 1800 may control the travelling unit and the cleaning unit to clean the sub-region in the first region.

Once cleaning of the first region is complete, the controller 1800 may transmit the position information of the region, in which a wet-type cleaning is unable to be performed, and a cleaning command to clean the sub-region in the first region, to the second moving robot 100*b*.

If the sub-region is located in any one of the plurality of regions in the travelling area, the controller 1800 may define a region, in which the sub-region is located, as the first region. Accordingly, the dry-type moving robot and the wet-type moving robot may alternately perform cleaning in an efficient manner.

The term "mop" used hereinafter may be made of various materials, such as fabrics or paper, and may be designed for repetitive use by washing or for one-time use as a disposable cloth.

Hereinafter, an overall description of the moving robot 100*b* according to another embodiment of the present disclosure will be given with reference to FIGS. 5 to 7.

The moving robot 100*b* according to embodiments of the present disclosure performs mopping. The moving robot 100*b* may be configured to move by itself. The moving robot 100*b* according to an embodiment of the present disclosure includes a body having a control unit.

The body 30 includes a case 31 forming an exterior, and a base 32 disposed below the case 31. An outer surface of the body 30 forms at least a portion of a circle having a reference radius and a radius having an error value within a standard error range. In this case, a circle having a reference radius and a radius having an error value within a standard error range indicates that the circle is not a perfect circle, and the radius may change within the error range at every central angle or in every region.

Specifically, 50% of the body 30 has a circular shape when viewed vertically, and a remaining portion of the body 30 may have a shape close to a circle considering a structure for coupling the remaining portion to other components. Here, the circle does not mean a perfect circle in mathematical terms, but a circle in engineering terms having an error.

The moving robot 100*b* includes a mop module 40 configured to mop a floor while being in contact with the floor (surface to be cleaned).

The mop module 40 is disposed below the body 30 and supports the body 30. In this embodiment, the body 30 is supported by the mop module 40. The body 30 forms an exterior.

The mop module 40 is disposed below the body 30. The mop module 40 provides a driving force for movement of the moving robot 100*b*. In order to move the moving robot 100*b*, the mop module 40 is preferably disposed at the rear side of the moving robot 100*b*.

The mop module 40 includes at least one mop unit 411 which mops the floor while rotating. The mop module 40 includes at least one spin mop 41, which when viewed from above, rotates clockwise or counter-clockwise. The spin mop 41 is in contact with the floor.

In this embodiment, the mop module 40 includes a pair of spin mops 41*a* and 41*b*.

The pair of spin mops 41*a* and 41*b* rotate clockwise or counter-clockwise when viewed from above, and mop the floor while rotating. Of the pair of the spin mops 41*a* and 41*b*, a spin mop, which is located at the left side when viewed from the front in a traveling direction of the cleaner, is defined as a left spin mop 41*a*, and a spin mop located at the right side is defined as a right spin mop 41*b*.

Each of the left spin mop 41*a* and the right spin mop 41*b* rotates about its rotation axis. The rotation axes thereof are disposed vertically. The left spin mop 41*a* and the right spin mop 41*b* may rotate independently of each other. The pair of spin mops 41*a* and 41*b* may be symmetrical to each other with respect to a virtual central vertical plane Po.

In the present disclosure, the moving robot includes a mop motor (not shown), which provides a driving force for the left spin mop 41*a* and the right spin mop 41*b*, and is installed at the body 30. The mop motor 61 includes a first mop motor 61*a* and a second mop motor 61*b*. A rotational axis of the mop motor may extend vertically. The first mop motor 61*a* and the second mop motor 61*b* are symmetrical to each other with respect to a central vertical line Po.

The central vertical line Po refers to a line which is parallel to a front-rear direction, and passes through the center of a geometric center Tc of the body 30. In this case, the central vertical line Po may be defined as a line which vertically intersects with a virtual line, formed by connecting a central axis of the left spin mop and a central axis of the right spin mop, and which passes through the geometric center Tc of the body 30.

If the bottom of the pair of spin mops 41*a* and 41*b*, which are symmetrical to each other with respect to the central vertical line Po, is disposed horizontal to a horizontal plane, the robot cleaner may not travel stably, such that it is difficult to control traveling. Accordingly, in the present disclosure, each spin mop 41 is inclined downwardly to the outer front side. Hereafter, the inclination and motion of the spin mop 41 will be described in detail.

Referring back to FIG. 7, a point, at which a spin shaft Osa and a lower surface of the left spin mop 41*a* intersect, and a point at which a spin shaft Osb and a lower surface of the right spin mop 41*b* intersect, are illustrated. When viewed from the bottom, a direction in which the left spin mop 41*a* spins clockwise is defined as a first forward direction w1*f*, and a direction in which the left spin mop 41*a* spins counter-clockwise is defined as a first reverse direction w1*r*. When viewed from the bottom, a direction in which the right spin mop 41*b* spins counter-clockwise is defined as a second forward direction w2*f*, and a direction in which the right spin mop 41*b* spins clockwise is defined as a second reverse direction w2*r*. Further, when viewed from the bottom, "an acute angle, formed between a tilt direction of the lower surface of the left spin mop 41*a* and a left-right axis thereof," and "an acute angle, formed between a tilt direction of the lower surface of the right spin mop 41*b* and the left-right axis thereof," are defined as tilt direction angles Ag1*a* and Ag1*b*. The tilt direction angle Ag1*a* of the left spin mop 41*a* may be equal to the tilt direction angle Ag1*b* of the right spin mop 41*b*. Further, referring to FIG. 3, "an angle of the lower surface I of the left spin mop 41*a* with respect to a virtual horizontal plane H" and "an angle of the lower surface I of the right spin mop 41*b* with respect to the virtual horizontal plane H" are defined as tilt angles Ag2*a* and Ag2*b*.

In this case, a right end of the left spin mop 41*a* and a left end of the right spin mop 41*b* may come into contact with, or may be adjacent to, each other. Accordingly, a gap in mopping between the left spin mop 41*a* and the right spin mop 41*b* may be reduced.

When the left spin mop 41*a* spins, a point P1*a* of the lower surface of the left spin mop 41*a*, to which a maximum frictional force is applied from the floor, is located on the left side of a center of rotation of the left spin mop 41*a*. As a greater load is transmitted to a ground surface at the point P1*a* of the lower surface of the left spin mop 41*a* than other points, the maximum frictional force may be generated at the point P1*a*. In the embodiment, the point P1*a* is located at a front left side of the center of rotation Osa, but in other embodiment, the point P1*a* may be disposed exactly at the left side or at the rear left side with respect to the center of rotation Osa.

When the right spin mop 41*b* spins, a point P1*b* of the lower surface of the right spin mop 41*b*, to which a maximum frictional force is applied from the floor, is located at the right side of a center of rotation Osb of the right spin mop 41*b*. As a greater load is transmitted to a ground surface at the point at the point P1*b* of the lower surface of the right spin mop 41*b* than other points, the maximum frictional force may be generated at the point P1*b*. In the embodiment, the point P1*b* is located at a front right side of the center of rotation Osb, but in other embodiment, the point P1*b* may be disposed exactly at the right side or at the rear right side with respect to the center of rotation Osb.

The lower surface of the left spin mop 41*a* and the lower surface of the right spin mop 41*b* may be inclined. The tilt angles Ag2*a* and Ag2*b* of the left spin mop 41*a* and the right spin mop 41*b* may form an acute angle. The tilt angles Ag2*a* and Ag2*b* are at the points P1*a* and P1*b*, at which the maximum frictional force is exerted, and the entire lower area of the mop 411 may be formed in a small size to touch the floor during spinning of the left spin mop 41*a* and the right spin mop 41*b*.

The overall lower surface of the left spin mop 41*a* is inclined leftwards and downwards. The overall lower surface of the right spin mop 41*b* is inclined rightwards and downwards. Referring to FIG. 6, the lower surface of the lower spin mop 41*a* has a lowest point P1*a* on the left side. The lower surface of the left spin mop 41*a* has a highest point Pha on the right side. The lower surface of the right spin mop 41*b* has a lowest point P1*b* on the right side. The lower surface of the right spin mop 41*b* has a highest point Pha on the left side.

Depending on embodiments, the tilt direction angles Ag1*a* and Ag1*b* may be zero degrees. Further, depending on embodiments, when viewed from the bottom, a tilt direction of the lower surface of the left spin mop 41*a* may form the tilt direction angle Ag1*a* in a clockwise direction with respect to the left-right axis, and a tilt direction of the lower surface of the right spin mop 41*b* may form the tilt direction angle Ag1*b* in a counter-clockwise direction with respect to the left-right axis. In this embodiment, when viewed from the bottom, a tilt direction of the lower surface of the left spin mop 41*a* may form the tilt direction angle Ag1*a* in a counter-clockwise direction with respect to the left-right axis, and a tilt direction of the lower surface of the right spin mop 41*b* may form the tilt direction angle Ag1*b* in a clockwise direction with respect to the left-right axis.

The moving robot 100*b* is moved by a frictional force with a ground surface, which is generated by the mop module 40.

The mop module 40 may generate "a forward movement frictional force" for moving the body 30 forward, or a "rearward movement frictional force" for moving the body 30 backwards. The mop module 40 may generate a "leftward moment frictional force" for turning the body 30 to the left, or a "rightward moment frictional force" for turning the body 30 to the right. The mop module 40 may generate a frictional force by combining any one of the forward movement frictional force and the rearward movement frictional force with any one of the leftward moment frictional force and the rightward moment frictional force.

In order for the mop module 40 to generate the forward movement frictional force, the left spin mop 41*a* spins at a predetermined rpm R1 in the first forward direction w1*f*, and the right spin mop 41*b* spins at the predetermined rpm R1 in the second forward direction w2*f*.

In order for the mop module 40 to generate the rearward movement frictional force, the left spin mop 41*a* spins at a predetermined rpm R2 in the first reverse direction w1*r*, and the right spin mop 41*b* spins at the predetermined rpm R2 in the second reverse direction w2*f*.

In order for the mop module 40 to generate the rightward moment frictional force, the left spin mop 41*a* spins at a predetermined rpm R3 in the first forward direction w1*f*, and the right spin mop 41*b* (i) spins in the second reverse direction w2*r*, (ii) is stopped without spinning, or (iii) spins at an rpm R4, which is less than the rpm R3, in the second forward direction w2*f*.

In order for the mop module 40 to generate the leftward moment frictional force, the right spin mop 41*b* spins at a predetermined rpm R5 in the second forward direction w2*f*, and the left spin mop 41*a* (i) spins in the first reverse direction w1*f*, (ii) is stopped without spinning, or (iii) spins at an rpm R6, which is less than the rpm R5, in the first forward direction w1*f*.

Hereinafter, an arrangement of each component for improving stability in a left-right direction and a front-rear direction while increasing a frictional force of the spin mops 41 located on the left and right sides, and allowing stable traveling regardless of a water level in a water tank 81.

Referring to FIG. 7, in order to increase a frictional force of the spin mop 41 and to prevent eccentricity from occurring in one direction when the moving robot rotates, a battery Bt and the mop motor 61, which are relatively heavy, may be disposed above the spin mop 41.

Specifically, the first mop motor 61*a* may be disposed over the left spin mop 41*a*, and the second mop motor 61*b* may be disposed over the right spin mop 41*b*. That is, at least a portion of the first mop motor 61*a* may overlap vertically with the left spin mop 41*a*. It is preferred that the entire portion of the first mop motor 61*a* may overlap vertically with the left spin mop 41*a*. At least a portion of the second mop motor 61*b* may overlap vertically with the right spin mop 41*b*. It is preferred that the entire portion of the second mop motor 61*b* may overlap vertically with the right spin mop 41*b*.

More specifically, the first mop motor 61*a* and the second mop motor 61*b* may overlap vertically with a virtual central horizontal line HL, formed by connecting the spin shaft Osa of the left spin mop 41*a* and the spin shaft Osb of the right spin mop 41*b*. It is preferred that a center of mass MCa of the first mop motor 61*a* and a center of mass MCb of the second mop motor 61*b* may overlap vertically with the virtual central horizontal line HL which is formed by connecting the spin shaft Osa of the left spin mop 41*a* and the spin shaft Osb of the right spin mop 41*b*. Alternatively, a geometric center of the first mop motor 61*a* and a geometric center of the second mop motor 61*b* may overlap vertically with the virtual central horizontal line HL which is formed by connecting the spin shaft Osa of the left spin mop 41*a* and the spin shaft Osb of the right spin mop 41*b*. In this case, the first mop motor 61*a* and the second mop motor 61*b* are symmetrical to each other with respect to the central vertical line Po of the moving robot.

As the center of mass MCa of the first mop motor 61*a* and the center of mass MCb of the second mop motor 61*b* are symmetrical to each other without deviating from each spin mop 41, a frictional force of the spin mop 41 may increase, while maintaining driving performance and horizontal balance.

Hereinafter, the spin shaft OSa of the left spin mop 41*a* is defined as a left spin shaft Osa, and the spin shaft Osb of the right spin mop 41*b* is defined as a right spin shaft Osb.

As the water tank 81 is disposed behind the central horizontal line HL, and the amount of water in the water tank 81 is variable, the first mop motor 61*a* may be biased leftward from the left spin shaft Osa in order to maintain a stable balance in the front-rear direction regardless of a water level in the water tank 81. The first mop motor 61*a* may be biased to the front left side from the left spin shaft Osa. It is preferred that the geometric center or the center of mass MCa of the first mop motor 61*a* is biased leftward from the left spin shaft Osa, or the geometric center or the center of mass MCa of the first mop motor 61*a* is biased to the front left side from the left spin shaft Osa.

The second mop motor 61*b* may be biased rightward from the right spin shaft Osb. The second mop motor 61*b* may be biased to the front right side from the right spin shaft Osb. It is preferred that the geometric center or the center of mass MCb of the second mop motor 61*b* is biased rightward from the right spin shaft Osb, or the geometric center or the center of mass MCb of the second mop motor 61*b* is biased to the front right side from the right spin shaft Osb.

As the first mop motor 61*a* and the second mop motor 61*b* apply pressure at positions which are biased toward an outer front side from the center of each spin mop 41, the pressure is concentrated on the outer front side of each spin mop 41, such that driving performance may be improved by the rotational force of the spin mop 41.

The left spin shaft Osa and the right spin shaft Osb are disposed behind the center of the body 30. The central horizontal line HL is disposed behind a geometric center of the body 30 and a center of mass WC of the moving robot. The left spin shaft Osa and the right spin shaft Osb are spaced apart equally from the central vertical line Po of the moving robot.

In this embodiment, a single battery Bt is installed. At least a portion of the battery Bt is disposed over the left spin mop 41*a* and the right spin mop 41*b*. As the battery Bt, which is relatively heavy, is disposed over the spin mop 41, a frictional force of the spin mop 41 may increase, and eccentricity occurring due to the rotation of the moving robot may be reduced.

Specifically, a portion of the left side of the battery Bt may vertically overlap with the left spin mop 41*a*, and a portion of the right side of the battery Bt may vertically overlap with the right spin mop 41*b*. The battery Bt may vertically overlap with the central horizontal line HL and may vertically overlap with the central vertical line Po of the moving robot.

More specifically, a center of mass BC or a geometric center of the battery Bt may be disposed on the central vertical line Po of the moving robot, and may be disposed on the central horizontal line HL. In this case, the center of mass BC or the geometric center of the battery Bt may be disposed on the central vertical line Po of the moving robot, may be disposed in front of the central horizontal line HL, or may be disposed behind the geometric center Tc of the body 30.

The center of mass BC or the geometric center of the battery Bt may be disposed in front of the water tank 81 or the center of mass PC of the water tank 81.

As one battery Bt is interposed between the left spin mop 41*a* and the right spin mop 41*b*, and is disposed on the central horizontal line HL and the central vertical line Po of the moving robot, the heavy battery Bt maintains the balance during the spinning of the spin mops 41, and puts weight on the spin mops 41, thereby increasing a frictional force of the spin mops 41.

The battery Bt may be disposed at the same height (height of a lower end) or on the same plane as the first mop motor 61*a* and the second mop motor 61*b*. The battery Bt may be interposed between the first mop motor 61*a* and the second mop motor 61*b*. The battery Bt is disposed in an empty space between the first mop motor 61*a* and the second mop motor 61*b*.

At least a portion of the water tank 81 is disposed on the left spin mop 41*a* and the right spin mop 41*b*. The water tank 81 may be disposed behind the central horizontal line HL, and may vertically overlap with the central vertical line Po of the moving robot.

More specifically, the center of mass PC or a geometric center of the water tank 81 may be disposed on the central vertical line Po and may be disposed in front of the central horizontal line HL. In this case, the center of mass PC or the geometric center of the water tank 81 may be disposed on the central vertical line Po and disposed behind the central horizontal line HL. Here, the position of the center of mass PC or the geometric center of the water tank 81, which is disposed behind the central horizontal line HL, indicates that the center of mass PC or the geometric center of the water tank 81 vertically overlaps with one region which is positioned behind the central horizontal line HL. In this case, the center of mass PC or the geometric center of the water tank 81 may vertically overlap with the body 30 without deviating from the body 30.

The center of mass PC or the geometric center of the water tank 81 may be disposed behind the center of mas BC of the battery Bt.

The water tank 81 may be disposed at the same height (height of a lower end) or on the same plane as the first mop motor 61*a* and the second mop motor 61*b*. The water tank 81 may be disposed rearward of a space between the first mop motor 61*a* and the second mop motor 61*b*.

At least some of the spin mops 41 may vertically overlap the body 30, and the other of the spin mops 41 may be exposed to the outside of the body 30. A percentage of a region of the spin mops 41 which vertically overlaps the body 30, is desirably 85% to 90% of each of the spin mops 41.

Specifically, an included angle between a line, formed by connecting the right end of the body 30 and the right end of the right spin mop 41*b*, and a central vertical line, formed by horizontally connecting the right end of the body 30 and the central vertical line Po, may be in a range of zero degrees to five degrees.

A length of the region of each spin mop 41, which is exposed to the outside of the body 30, is desirably in a range of ½ to ⅐ of a radius of each spin mop 41. The length of the region of each spin mop 41, which is exposed to the outside of the body 30, may refer to a distance between one end of each spin mop 41, which is exposed to the outside of the body 30, to the spin shaft of each spin mop 41.

A distance between the end of the region of each spin mop 41, which is exposed to the outside of the body 30, and the geometric center Tc of the body 30 may be greater than a mean radius of the body 30.

A position, at which each spin mop 41 is exposed, is between a side portion and a rear portion of the body 30. That is, if quadrants are sequentially positioned in a clockwise direction when the body 30 is viewed from below, the position, at which each spin mop 41 is exposed, may be located in the second quadrant or the third quadrant.

Referring to FIG. 8, Referring to FIG. 4, a sensing unit 20 is included, which senses a variety of information related to the motion or state of the moving robot 100*b* or external circumstances thereof.

The sensing unit 20 may include an obstacle sensor 21 for sensing an external obstacle which is spaced apart from the moving robot 100*b*. A plurality of obstacle sensors may be provided. The obstacle sensor 21 includes the obstacle sensors for sensing front obstacles. The obstacle sensor 21 includes the obstacle sensor for sensing left and right obstacles. The obstacle sensor 21 may be disposed at the body 30. The obstacle sensor 21 may include an infrared sensor, an ultrasonic sensor, an RF sensor, a geomagnetic sensor, a Position Sensitive Device (PSD) sensor, and the like.

The sensing unit 20 may include a position signal sensor 22 for determining a position by receiving an identification signal from an external source. For example, the position signal sensor 22 may be an Ultra-Wide Band (UWB) sensor using an Ultra-Wide Band (UWB) signal. The controller 10 may identify the position of the moving robot cleaner 100*b* based on the signal received by the position signal sensor 22.

The external identification signal is a signal transmitted by an external signal generator, such as a beacon located at an external position and the like. A plurality of signal generators may be provided at positions which are spaced apart from each other. Accordingly, the position signal sensor 22 may receive identification signals transmitted from signal generators positioned at different places.

The sensing unit 20 may include a cliff sensor 23*a* for sensing the presence of a cliff on the floor or a distance from the floor. The cliff sensor 23*a* may detect the presence of a cliff at the front and/or rear of the moving robot 100*b*. The cliff sensor 23*a* senses a distance from the floor; and if the distance from the floor is greater than a predetermined distance, the controller 10 determines that there is a cliff, and may control the moving robot 100*b* to perform a motion in response to the cliff.

For example, the cliff sensor 23*a* may include an optical sensor, and the optical sensor may include a laser sensor or an infrared sensor. The cliff sensor 23*a* may include a light emitter (not shown) for emitting light onto the floor, and a light receiver (not shown) for receiving light reflected from the floor. The cliff sensor 23*a* may measure the distance based on a time difference between the emitted light and the light returning to the light receiver.

Further, the cliff sensor 23*a* may sense reflectance of light reflected from the floor.

Specifically, by measuring an amount, illuminance, and the like of the returning light, the light receiver may obtain reflectance of the returning light compared to the light emitted by the light emitter. By sensing reflectance of light reflected from the floor, the cliff sensor 23*a* may provide the controller 10 with a means for detecting a material of the floor.

The cliff sensor 23*a* may be disposed in front of the pair of spin mops 41. As the cliff sensor 23*a* is disposed in front of the pair of spin mops 41, the pair of spin mops 41may avoid a carpet in advance before load is increased due to the carpet and the like.

The sensing unit 20 may include an optical flow sensor 23*b* which detects an amount of movement of the moving robot based on a floor image. The optical flow sensor 23*b* may sense reflectance of light reflected from the floor. Alternatively, the optical flow sensor 23*b* may obtain downward image information by using light at predetermined time intervals, and may provide the downward image information to a flow material determining unit 12 or the controller 10.

The optical flow sensor 23*b* generates image data in a predetermined format by converting a downward image input from an image sensor included in the optical flow sensor. The generated image data may be transmitted to the controller 10.

In addition, the optical flow sensor (OFS) 23*b* may include an image sensor (not shown) configured to capture downward images to obtain downward image information, and one or more light sources (not shown) configured to emit planar light onto the floor.

The one or more light sources may emit light to a predetermined area of a floor surface, images of which are captured by the image sensor. That is, when the moving robot travels in a specific area along the floor surface, if the floor surface is a flat surface, a predetermined distance may be maintained between the image sensor and the floor surface.

By contrast, if the moving robot moves on an uneven floor surface, a distance therebetween increases due to unevenness and an obstacle CA on the floor surface. In this case, the controller 10 may control the one or more light sources to adjust an amount of the emitted light. The light sources may be a light emitting element, e.g., a light emitting diode (LED) and the like.

By using the optical flow sensor 23*b*, the controller 10 may detect the position of the moving robot regardless of slipping of the moving robot. The controller 10 may calculate a distance and direction of movement by comparing and analyzing the image data, captured by the optical flow sensor 23*b*, according to elapsed time, and may calculate the position of the moving robot based on the calculation. By using image information on a lower part of the moving robot, which is obtained by the optical flow sensor 23*b*, the controller 10 may perform calibration, which is robust to slipping, on the position of the moving robot which is calculated by other means.

The optical flow sensor 23*b* may provide the controller 10 with a means for detecting a material of the floor by sensing reflectance of light reflected from the floor or by analyzing an image of the floor.

The optical flow sensor 23*b* may be disposed so that at least a portion of the optical flow sensor 23*b* may vertically overlap the central vertical plane. Specifically, on the central vertical plane, the optical flow sensor 23*b* is disposed in front of a line, formed by connecting central axes of the pair of spin mops 31. In another example, the optical flow sensor 23*b* may be disposed in front of the pair of spin mops 41.

When the optical flow sensor 23*b* is disposed in front of the mop module, the mop module may avoid a carpet in advance before load is increased due to the carpet and the like.

Accordingly, even when only one optical flow sensor 23*b* is used, rather than using a plurality of optical flow sensors 23*b*, the optical flow sensor 23*b* may detect a material of the floor in front of the pair of spin mops, since the optical flow sensor 23*b* is disposed at a position leaning forward from the center of the body 30.

Further, the present disclosure has an effect in that while performing existing functions of detecting a cliff and an amount of movement of the moving robot, the cliff sensor 23*a* and the optical flow sensor 23*b* may also detect a material of the floor.

The sensing unit 20 may include a camera 24 for sensing an external image. The camera 24 may be disposed at the body 30, and may sense an upward image of the body 30 at predetermined time intervals.

The sensing unit 20 may include a 3D sensor 25 for sensing three-dimensional (3D) position information of an external environment. The 3D sensor 25 may obtain upward image information at predetermined time intervals.

For example, the 3D sensor 25 may include: a light emitter (not shown) for emitting infrared light; and a 3D camera (3D Depth Camera, not shown) for sensing the infrared light reflected from an external object. The light emitter may also emit infrared light having a predetermined pattern. The 3D camera may be an IR camera, an RGB-Depth camera, and the like. Such 3D sensor 25 may be implemented using a time-of-flight (TOF) scheme.

In another example, the 3D sensor 25 may be implemented by using stereo vision techniques, in which 3D coordinate information is generated by combining two or more images acquired using two or more cameras.

The sensing unit 20 may include a slope information obtainer (not shown) for obtaining slope information on a floor (H) of the body 30. For example, the slope information obtainer may include a gyro sensor 26. The slope information obtainer may include a processing module (not shown) for converting a sensing signal of the gyro sensor 26 into slope information. The processing module, which is provided as part of the controller 10, may be implemented using an algorithm or a program. In another example, the slope information obtainer may include a magnetic field sensor 27, and may obtain slope information based on sensing information on the magnetic field of the earth.

Here, the floor (H) refers to a horizontal plane, and a plane which is perpendicular to the direction of gravity. The gyro sensor 26 may obtain information on a rotating angular speed with respect to a horizontal plane of the body 30. Specifically, the gyro sensor 26 may sense a rotating angular speed around the X-axis and the Y-axis which are parallel to the horizontal plane and mutually cross at right angles. The rotating angular speed in a horizontal plane may be calculated by synthesizing a rotating angular speed (roll) around the X-axis and a rotating angular speed (pitch) around the Y-axis using the processing module. A slope value may be calculated by integrating the rotating angular speed using the processing module.

The gyro sensor 26 may sense a determined reference direction. The slope information obtainer may obtain slope information based on the reference direction.

The gyro sensor 26 may have a gyro sensing function for three axes in a space coordinate system which mutually cross at right angles. Information collected by the gyro sensor 26 may include roll, pitch and yaw information. The processing module may calculate a direction angle of the moving robot 100*b* by integrating roll, pitch and yaw angular speeds.

The gyro sensor 26 is preferably disposed at the body 30. Accordingly, the gyro sensor 26 is disposed in a remaining part Q, which will be described later, and in which the body 30 is included. Further, the slope information obtainer is disposed in the remaining part Q.

The gyro sensor 26 may be implemented as a separate sensor, or may function as part of an IMU sensor which will be described later.

The sensing unit 20 may include the magnetic field sensor 27 for sensing the magnetic field. The magnetic field sensor 27 may have a magnetic field sensing function for three axes in a space coordinate system which mutually cross at right angles. The magnetic field sensor 27 may measure a direction angle (azimuth). The magnetic field sensor 27 may be implemented as a separate sensor, or may function as part of an IMU sensor which will be described later.

The sensing unit 20 may include an acceleration sensor 28 for sensing the gravity of the moving robot 100*b*. The acceleration sensor 28 may provide an acceleration sensing function for three axes in a space coordinate system which mutually cross at right angles. The acceleration sensor 28 may be implemented as a separate sensor, or may function as part of an IMU sensor which will be described later.

The moving robot 100*b* may include an inertial sensor unit (IMU, not shown). Based on information of the inertial sensor unit, the moving robot 100*b* may stabilize traveling motions of the moving robot 100*b*. The IMU may function as the gyro sensor 26, the magnetic field sensor 27, and the acceleration sensor 28.

The sensing unit 20 may include a mop load information sensor 29 for obtaining load information (load value) of a mop motor 61.

For example, the mop load information sensor 29 may sense load on a mop motor 61 by sensing a motor load current value, a motor load voltage value, or the like of the mop motor 61. Specifically, the mop load information sensor 29 may be implemented using a current detector included in a mop motor controller.

In another example, the mop load information sensor 29 may be provided with an encoder which senses the rotation speed or RPM of the spin mop. Specifically, as the load applied on the mop 411 increases, the rotation speed may be reduced compared to a rotation signal (current value, voltage value, etc.) applied on the mop motor 61. In this case, load information may be obtained by using the encoder which senses rotation speed information.

The sensing unit 20 may include an impact sensor (not shown) for sensing contact with an external obstacle. The impact sensor may be implemented by using a bumper (not shown) which is pressed by an external object.

The sensing unit 20 may include an encoder (not shown) which recognizes an actual moving path of the moving robot 100*b*. The function of the encoder may also be performed by an auxiliary wheel 58.

The moving robot 100*b* includes an input unit 16 which inputs a user's various instructions. The input unit 16 may include a button, a dial, a touch-type display, and the like. The input unit 16 may include a microphone (not shown) for voice recognition, and a power switch 16*a* for switching ON and OFF the power supply.

The moving robot 100*b* includes an output unit 17 for outputting a variety of information to a user. The output unit 17 may include a display (not shown) for outputting visual information, and a speaker (not shown) for outputting auditory information.

The moving robot 100*b* includes a storage 18 for storing a variety of information. The storage 18 may include a volatile or non-volatile recording medium. The storage 18 may store algorithms for controlling various motions of the moving robot 100*b* in response to errors.

The storage 18 may include a map of a traveling area. The map may be input by an external terminal which may exchange information through a communicator 19, or the moving robot 100*b* may generate the map by learning by itself. In the former case, examples of the external terminal may include a remote control, a PDA, a laptop computer, a smartphone, a tablet PC, and the like, in which an application for setting up the map is installed.

The moving robot 100*b* may include the communicator 19 which may access a predetermined network. The communicator 19 may be implemented using wireless communication techniques, such as IEEE 802.11 WLAN, IEEE 802.15 WPAN, UWB, Wi-Fi, Zigbee, Z-wave, Blue-Tooth, and the like, according to a communication protocol.

The moving robot 100*b* includes a controller 10 for controlling autonomous traveling. The controller 10 may be implemented on a main PCB (Co) disposed in the body 30.

The controller 10 may process a signal of the input unit 16 or a signal input through the communicator 19.

The controller 10 may control traveling of the moving robot 100*b* by receiving a sensing signal of the sensing unit 20. The controller 10 may control the mop motor 61 by receiving a sensing signal of the sensing unit 20.

The controller 10 may control a water supply module (not shown). The controller 10 may control a pump (not shown) for adjusting an amount of supplied water. By controlling the pump (not shown), the controller 10 may adjust an amount of water per hour which is supplied to the top module 40. In another example, the controller 10 may control a value, which will be described later, to change whether to supply water.

The controller 10 may learn a traveling area by using images (upward image information) captured by the camera 24 or the 3D sensor, and may recognize (detect) a current position. The controller 10 may be configured to map the traveling area through the images, and may recognize the current position on the map. The images captured by the camera 24 may be used to generate the map of the traveling area and to recognize the current position in the traveling area.

For example, the controller 10 may generate the map of the traveling area by using an image of a boundary between a ceiling and a side surface, among upward images captured by the camera 24. Further, the controller 10 may sense the current position in the traveling area based on feature points of the images.

The controller 10 may control the moving robot 100*b* to return to a charging station after traveling. For example, the moving robot may be configured to return to the charging station by sensing an infrared (IR) signal and the like transmitted from the charging station. The controller 10 may control the moving robot 100*b* to return to the charging station based on the sensed signal which is transmitted from the charging station. The charging station may include a signal transmitter (not shown) which transmits a predetermined returning signal.

In another example, by recognizing the current position on the map, the controller 10 may control the moving robot 100*b* to return to the charging station. The controller 10 may recognize a position, corresponding to the charging station, and the current position on the map, and the moving robot 100*b* may return to the charging station based on the positions.

The controller 10 may control the moving robot 100*b* based on information input through a user's terminal (e.g., smartphone, computer, etc.). The moving robot 100*b* may receive the input information through the communicator 19. Based on the input information, the controller 10 may control a traveling pattern (e.g., traveling in a zigzag path or traveling for intensively cleaning a certain area). Based on the input information, the controller 10 may control whether to activate a specific function (e.g., finding lost articles, repelling insects, etc.) of the moving robot 100*b*. Further, based on the input information, the controller 10 may set a start time of a cleaning traveling mode of the moving robot 100*b* to a specific time (cleaning reservation function).

The controller 10 includes the controller 10 of the mop motor 61 which controls driving of the mop motor 61. The controller 10 may include a first mop motor controller to control driving of the first mop motor 61*a*. The controller 10 may further include a second mop motor controller to control driving of the second mop motor 61*b*.

In the case of a moving robot which is moved by a frictional force between the spin mop and a ground surface, if the spin mop moves into a floor of a material such as carpet and the like, the moving robot may be trapped by the carpet. In order to solve the problem, the present disclosure provides a method of determining in advance whether a floor material is a dangerous material by using various sensors.

The controller 10 may determine the sub-region in the travelling area based on information input by at least one of the optical flow sensor 23*b*, the acceleration sensor 28, the cliff sensor 23*a*, and the mop load information sensor 29.

The controller 10 may determine the sub-region in the travelling area by independently or comprehensively considering information input by the optical flow sensor 23*b*, the acceleration sensor 28, the cliff sensor 23*a*, and the mop load information sensor 29.

The controller 10 may determine a floor material based on downward image information acquired by the optical flow sensor 23*b*, and if the floor material is a dangerous material, the controller 10 may set a current position (or current position and a surrounding area thereof) as the sub-region.

Specifically, the controller 10 may calculate at least one of a reflectance value of the floor, an image quality value of the downward image, and a frame rate of the downward image based on the downward image information; and if at least one of the following conditions 1, 2, and 3 is satisfied, the controller 10 may determine a floor material to be a dangerous material.

Condition 1

An image quality value is less than a predetermined reference quality value.

Condition 2

A frame rate is less than a predetermined reference frame rate.

Condition 3

A reflectance value of the floor is less than a predetermined reflectance value.

In another example, the controller 10 may calculate an image quality value of the downward image based on the downward image information; and if the image quality value is less than the predetermined reference image quality value, the controller 10 may determine that a floor material is a dangerous material.

In yet another example, the controller 10 may calculate a frame rate of the downward image based on the downward image information; and if the frame rate is less than the predetermined reference frame rate, the controller 10 may determine that a floor material is a dangerous material.

In still another example, the controller 10 may calculate a reflectance value of the floor based on the downward image information; and if the reflectance value of the floor is less than the predetermined reference reflectance value, the controller 10 may determine that a floor material is a dangerous material.

Here, the image quality value is defined as a value obtained by quantifying a state of the downward image captured by the optical flow sensor 23*b*.

The image quality value may be determined based on a shape of an image formed on the floor by light emitted from a light source. That is, the light source emits a planar light beam of a predetermined shape onto the floor, and a degree of similarity to the shape of the planar light, emitted from the light source, in the captured downward image is defined as the image quality value.

In another example, a process of measuring an image quality may be a process of measuring suitability of a contrast ratio after an equalization process with a histogram. The image quality measuring process may include a binarization process and the process of measuring suitability of a contrast ratio.

The equalization process may be a process for improving a recognition rate of the downward image by histogram analysis. The acquired downward image may include a plurality of pixels. The histogram shows a distribution of gray level values of the plurality of pixels included in the downward image. That is, the histogram indicates a distribution of light and shade portions distributed in the downward image. Specifically, in a 256-gray level image, gray level values range from 0 to 255. The histogram shows a frequency of the gray level values of the respective pixels in a bar graph. The equalization process is a process of equalizing the distribution of gray level values if the gray level values are biased to one side or are non-uniformly distributed. That is, the equalization process is a process of distributing the gray level values, concentrated on one side, to achieve a uniform distribution of the values. By the equalization process, shade portions of the downward image become brighter, and light portions thereof become darker, such that the respective pixels may have appropriate gray level values.

The binarization process is a process of dividing the respective pixels, included in the downward image, into black or white regions, after the equalization process. The downward image, after the equalization process, may have complex shades, such that the respective pixels may be binarized to either black or white by the binarization process. In order to divide the pixels into black or white in the binarization process, a threshold value is required. The threshold value may be a set value for dividing the pixels into black or white. If the gray level value of a pixel is greater than the threshold value, the pixel may be binarized to 0 (black); and if the gray level value of a pixel is less than the threshold value, the pixel may be binarized to 1 (white).

A process of determining suitability of a contrast ratio may be a process of determining whether the contrast ratio of the binarized pixels satisfies a predetermined ratio.

If a ratio of black pixels is relatively high, a low image quality value is obtained; and if the image quality value is low, the floor may have high roughness or may be a carpet. Accordingly, in the present disclosure, if the image quality value is less than the reference image quality value, the floor material is determined to be a dangerous material.

In addition, reflectance of the floor may be a value obtained by dividing the white pixels by the black pixels. In another example, reflectance of the floor may be defined as a quantity of light emitted by the light source, reflected from the floor, and incident on a light receiver (not shown).

In the case of a wood floor, a marble floor, or a linoleum floor which has high reflectance and is a flat material, an image quality value of the downward image is high, with high floor reflectance and a high frame rate. However, if a floor material has low reflectance or has high roughness, an image quality value of the downward image is low, with low floor reflectance and a low frame rate.

Accordingly, in the present disclosure, a floor material is determined based on a difference in a plurality of parameters of the downward image of the optical flow sensor, the moving robot may avoid a dangerous area before entering. Particularly, as the plurality of parameters may be verified by cross-validation or independent validation by using one sensor, a floor material may be determined accurately.

Therefore, by determining that an area having low reflectance is a carpet area, the moving robot may avoid the area while traveling. In this manner, a problem that the moving robot is difficult to escape from the carpet may be solved, which occurs when the moving robot receiving a driving force by rotation of a mop moves into the carpet.

In another example, the controller 10 may determine a floor material based on a distance from the floor, obtained by the cliff sensor 23*a*, and the downward image information acquired by the optical flow sensor 23*b*.

Specifically, if a value of the distance from the floor, obtained by the cliff sensor 23*a*, is less than a reference distance value, the control unit 10 may control a mop motor to perform an entry restriction operation. In this case, the control unit 10 may determine a floor material based on the downward image information acquired by the optical flow sensor 23*b*.

If a value of the distance from the floor, obtained by the cliff sensor 23*a*, is greater than the reference distance value and less than a maximum value, the control unit 10 may control the mop motor to allow the moving robot to travel normally.

The cliff sensor 23*a* is disposed at a front end of the body and detects a stepped part between a floor (reference floor), being in contact with a spin mop, and the floor below the front end of the body. Based on the value detected by the cliff sensor 23*a*, a cliff may be detected, and a floor higher than the reference floor may be detected. If a floor is higher than the reference floor, the control unit 10 may determine that a carpet is laid on the floor, and may control the moving robot to avoid the carpet.

By using a plurality of measurement means of the cliff sensor 23*a* and the optical flow sensor 23*b*, an error in determining the floor material may be reduced.

In yet another example, while a portion of the spin mop enters a dangerous area, the moving robot may also determine whether a current position is in a dangerous area.

The control unit 10 may control the moving robot 1 based on a mop load value sensed by the mop load information sensor 29. Specifically, if a mop load value, sensed by the mop load information sensor 29, is greater than a predetermined reference load value, the control unit 10 may control the mop motor 61 to perform an entry restriction operation.

In addition, if a mop load value, sensed by the mop load information sensor 29, is less than the predetermined reference load value, the control unit 10 may control the mop motor 61 to travel normally.

In still another example, the control unit 10 may calculate an average acceleration value from the acceleration values; and if the average acceleration value is greater than a reference average acceleration value, the control unit 10 may control the mop motor 61 to perform an entry restriction operation. Further, the control unit 10 may calculate dispersion of acceleration values; and if the dispersion is greater than a reference dispersion, the control unit 10 may control the mop motor 61 to perform an entry restriction operation.

Furthermore, if the average acceleration value is greater than a reference average acceleration value, the control unit 10 may control the mop motor 61 to travel normally. In addition, if the dispersion is less than the reference dispersion, the control unit 10 may control the mop motor 61 to travel normally.

Accordingly, in the present disclosure, even when a dangerous area may not be detected in advance by the cliff sensor 23*a* and the optical flow sensor 23*b*, the moving robot may determine a dangerous area at an early stage after entering the dangerous area, based on a plurality of factors or a single factor, such as the load of the spin mop, information obtained by the acceleration sensor 28, and the like.

In addition, based on various motions of the moving robot, such as rotation, forward movement, etc., it is possible to rapidly determine a portion of the moving robot stuck in the carpet and the like, such that the moving robot may rapidly escape from the place.

In still another example, if at least one of the following conditions 4 to 7 is satisfied, the control unit 10 may determine the location to be a sub-region.

Condition 4

A load value of the mop motor is greater than a predetermined reference load value.

Condition 5

A value of a distance from the floor is less than a reference distance value.

Condition 6

An average acceleration value is greater than a reference average acceleration value.

Condition 7

An acceleration dispersion value is greater than a reference dispersion value.

In still another example, if at least one of the above conditions 1 to 7 is satisfied, the control unit 10 may determine the location to be a sub-region.

Referring to FIGS. 9A and 9B, the first moving robot 100*a* and the second moving robot 100*b*, which move autonomously, may exchange data through a network communication 50. Further, according to a control command received from a terminal 300 through the network communication 50 or other communication, the first moving robot 100*a* and/or the second moving robot 100*b* which move autonomously may perform an operation related to cleaning or a corresponding operation.

That is, although not illustrated herein, the plurality of moving robots 100*a* and 100*b*, which move autonomously, may communicate with the terminal 300 through a first network communication, and may communicate with each other through a second network communication.

Here, the network communication 50 may refer to a near field communication using at least one of wireless communication techniques such as Wireless LAN (WLAN), Wireless Personal Area Network (WPAN), Wireless-Fidelity (Wi-Fi), Wireless-Fidelity (Wi-Fi) Direct, Digital Living Network Alliance (DLNA), Wireless Broadband (WiBro), World Interoperability for Microwave Access (WiMAX), Zigbee, Z-wave, Blue-Tooth, Radio Frequency Identification (RFID), Infrared Data Association (IrDA), Ultrawide-Band (UWB), Wireless Universal Serial Bus (USB), and the like.

The illustrated network communication 50 may vary according to a communication scheme used by the moving robots to communicate with each other.

Referring to FIG. 9A, each of the first moving robot 100*a* and/or the second moving robot 100*b*, which move autonomously, may provide information, sensed by their respective sensing units, to the terminal 300 through the network communication 50. In addition, the terminal 300 may transmit a control command, generated based on the received information, to the first moving robot 100*a* and/or the second moving robot 100*b* through the network communication 50.

Furthermore, referring to FIG. 9A, a communicator of the first moving robot 100*a* and a communicator of the second moving robot 100*b* may directly communicate with each other or may communicate with each other indirectly via a router (not shown) and the like.

For example, the second moving robot 100*b* may perform a traveling operation and a cleaning operation according to a control command received from the first moving robot 100*a*. In this case, the first moving robot 100*a* may operate as a master and the second moving robot 100*b* may operate as a slave.

Alternatively, it can be said that the second moving robot 100*b* follows the first moving robot 100*a*. Further, it can be said that in some cases the first moving robot 100*a* and the second moving robot 100*b* operate in conjunction with each other.

Hereinafter, a system including the plurality of moving robots 100*a* and 100*b*, which move autonomously, according to an embodiment of the present disclosure will be described with reference to FIG. 9B.

Referring to FIG. 9B, a cleaning system according to an embodiment of the present disclosure may include the plurality of moving robots 100*a* and 100*b* which move autonomously, the network communication 50, a server 500, and a plurality of terminals 300*a* and 300*b*.

Among these, the plurality of moving robots 100*a* and 100*b*, the network communication 50, and at least one terminal 300*a* may be positioned inside a building 10, and the other terminal 300*b* and the sever 500 may be positioned outside the building 10.

The plurality of moving robots 100*a* and 100*b* are cleaners which perform cleaning while moving autonomously and may perform autonomous traveling and cleaning. Each of the plurality of moving robots 100*a* and 100*b* may include a communicator 1100 provided therein, in addition to the traveling function and the cleaning function.

Furthermore, the plurality of moving robots 100*a* and 100*b*, the server 500, and the plurality of terminals 300*a* and 300*b* may be connected to each other through the network communication 50, to exchange data with each other. To this end, although not illustrated herein, a wireless router, such as an access point (AP) device and the like, may be further included in the system. In this case, the terminal 300*a* located in an internal network may access at least one of the plurality of moving robots 100*a* and 100*b* through the AP device, such that the terminal 300*a* may perform monitoring and remote control of the cleaner and the like. In addition, the terminal 300*b* located in an external network may also access at least one of the plurality of moving robots 100*a* and 100*b* through the AP device, such that the terminal 300*b* may perform monitoring and remote control of the cleaner and the like.

The server 500 may be wirelessly connected to the plurality of moving robots 100*a* and 100*b* directly through the mobile terminal 300*b*. Alternatively, the server 500 may be connected to at least one of the plurality of moving robots 100*a* and 100*b* without passing through the mobile terminal 300*b*.

The server 500 may include a processor capable of processing programs and may include various algorithms. For example, the server 500 may include algorithms related to machine learning and/or data mining.

In another example, the server 500 may include speech recognition algorithms. In this case, upon receiving voice data, the server 500 may convert the received voice data into data in text form and may output the data.

The server 500 may store firmware information and driving information (course information, etc.) of the plurality of moving robots 100*a* and 100*b* and may register production information of the plurality of moving robots 100*a* and 100*b*. For example, the server 500 may be a server operated by a manufacturer of the cleaner or a server operated by an operator of an application store which is open to the public.

In another example, the server 500 may be a home server provided in the internal network 10 to store state information on home appliances or to store content shared by the home appliances. In the case where the server 500 is a home server, the server 500 may store information related to foreign matter, e.g., images of the foreign matter and the like.

In addition, the plurality of moving robots 100*a* and 100*b* may be wirelessly connected to each other directly through Zigbee, Z-wave, Blue-Tooth, Ultra-wide Band, and the like. In this case, the plurality of moving robots 100*a* and 100*b* may exchange position information and traveling information.

In this case, any one of the plurality of moving robots 100*a* and 100*b* may operate as a master moving robot 100s and the other one may operate as a slave moving robot 100*b*. For example, the first moving robot 100*a* may be a dry cleaner suctioning dust from the floor to be cleaned, and the second moving robot 100*b* may be a wet cleaner mopping the cleaned floor with a wet mop.

Furthermore, the structure and specification of the first moving robot 100*a* and the second moving robot 100*b* may be different from each other. In this case, the first moving robot 100*a* may control traveling and cleaning of the second moving robot 100*b*. In addition, the second moving robot 100*b* may perform traveling and cleaning while following the first moving robot 100*a*. Here, the second moving robot 100*b* following the first moving robot 100*a* may indicate that the second moving robot 100*b* follows the first moving robot 100*a* while maintaining a proper distance from the first moving robot 100*a* and performs traveling and cleaning while following.

Referring to FIG. 9C, the first moving robot 100*a* may control the second moving robot 100*b* to follow the first moving robot 100*a*.

To this end, the first moving robot 100*a* and the second moving robot 100*b* should be located within a specific area where the first moving robot 100*a* and the second moving robot 100*b* may communicate with each other, and the second moving robot 100*b* should identify at least a relative position of the first moving robot 100*a*.

For example, the communicator of the first moving robot 100*a* and the communicator of the second moving robot 100*b* may mutually exchange an IR signal, an ultrasonic signal, a carrier wave frequency, an impulse signal, and the like, and may calculate the displacement of the first moving robot 100*a* and the second moving robot 100*b* by analyzing the signals by triangulation and the like, relative positions of the first moving robot 100*a* and the second moving robot 100*b* may be identified.

However, the positions of the first moving robot 100*a* and the second moving robot 100*b* are identified by signal exchange on the assumption that each of the first moving robot 100*a* and the second moving robot 100*b* has a position sensor, or a distance therebetween is sufficiently short. Accordingly, the present disclosure provides a method of allowing the first moving robot 100*a* and the second moving robot 100*b* to easily identify each other's positions within a designated space regardless of a distance therebetween.

As described above, once the first moving robot 100*a* identifies a relative position between the first moving robot 100*a* and the second moving robot 100*b*, the second moving robot 100*b* may be controlled based on map information stored in the first moving robot 100*a* or map information stored in the server, mobile terminal, and the like. In addition, the second moving robot 100*b* may share obstacle information sensed by the first moving robot 100*a*. Furthermore, the second moving robot 100*b* may perform an operation according to a control command (e.g., control commands related to a traveling direction, a traveling speed, halt, etc.) which is received from the first moving robot 100*a*.

Specifically, the second moving robot 100*b* performs cleaning while moving along a traveling path of the first moving robot 100*a*. However, a traveling direction of the first moving robot 100*a* is not always the same as a traveling direction of the second moving robot 100*b*. For example, when the first moving robot 100*a* moves or rotates upward/downward/leftward/rightward, the second moving robot 100*b* moves or rotates upward/downward/leftward/rightward after a predetermined period of time elapses, such that a current traveling direction thereof may be different.

In addition, a traveling speed Va of the first moving robot 100*a* may be different from a traveling speed of the second moving robot 100*b*. The first moving robot 100*a* may control the traveling speed Va of first moving robot 100*a* and/or the traveling speed Vb of the second moving robot 100*b* to be changed in consideration of a distance for communication between the first moving robot 100*a* and the second moving robot 100*b*.

For example, if the first moving robot 100*a* and the second moving robot 100*b* move away from each other by a predetermined distance or more, the first moving robot 100*a* may control the traveling speed Vb of the second moving robot 100*b* to become faster than a previous speed. Further, if the first moving robot 100*a* and the second moving robot 100*b* move close to each other within a predetermined distance or more, the first moving robot 100*a* may control the traveling speed Vb of the second moving robot 100*b* to become slower than a previous speed or may control the second moving robot 100*b* to halt for a predetermined period of time. In this manner, the second moving robot 100*b* may perform cleaning while continuously following the first moving robot 100*a*.

In addition, although not illustrated herein, the first moving robot 100*a* and the second moving robot 100*b* may perform cooperative cleaning by dividing a designated space. To this end, the first moving robot 100*a* and the second moving robot 100*b* have a history of cleaning the designated space and have an obstacle map in which coordinates of their positions are indicated.

The obstacle map may include information related to regions of a specific space (e.g., shape of regions, positions of walls, height of a floor, positions of a door/threshold, etc.), position information of a cleaner, position information of a charging station, and information on obstacles located in the specific space (e.g., the position and size of obstacles, etc.). Here, the obstacles may include fixed obstacles, such as walls, furniture, furnishings, etc., which protrude from the floor of an area B to be cleaned and obstruct traveling of the cleaner, and moving obstacles, as well as a cliff.

The obstacle map stored in the first moving robot 100*a* may be different from the obstacle map stored in the second moving robot 100*b*. For example, if the first moving robot 100*a* and the second moving robot 100*b* are of different types, or if obstacle sensors (e.g., ultrasonic sensor, laser sensor, radio wave sensor, infrared sensor, bumper, etc.) included in the first moving robot 100*a* and the second moving robot 100*b* are different from each other, different obstacle maps may be generated even for the same space.

In addition, each memory 1700 of the first moving robot 100*a* and the second moving robot 100*b* may store at least an obstacle map, pre-generated for a designated space before performing cooperative cleaning, and map data related thereto.

Here, each obstacle map may be generated as a two-dimensional (2D) or three-dimensional (3D) image or as a grid map for the designated space. Further, each obstacle map may include information on at least one obstacle, e.g., the position and size information of a table, a wall surface, a threshold, etc.), as well as their position information (i.e., position information of the first moving robot 100*a* and the second moving robot 100*b*) and position information of a wet contaminated region in the area B to be cleaned.

Further, each obstacle map may be the same as the shape of an actual designated space and may be generated with the same scale based on measured values on a plan view.

Each of the first moving robot 100*a* and the second moving robot 100*b* may independently perform traveling and cleaning in a designated space. However, if performing cleaning in a separate scenario, rather than cooperative cleaning, a traveling trajectory of the first moving robot 100*a* may overlap a traveling trajectory of the second moving robot 100*b*, and the like, which is contrary to the purpose of efficient cleaning by using a plurality of moving robots.

Accordingly, in the present disclosure, a plurality of moving robots may identify each other's positions in a designated space without using a position sensor, to perform cooperative cleaning/cleaning while following.

Specifically, in the present disclosure, the first moving robot 100*a* may communicate with the second moving robot 100*b* to receive an obstacle map, on which the position of the second moving robot 100*b* and an artificial mark are indicated, from the second moving robot 100*b*. Further, the received obstacle map may be calibrated based on the artificial mark of the obstacle map of the first moving robot 100*a* to match a coordinate system. Further, by using the obstacle map of the second moving robot 100*b*, in which the coordinate system is matched, the first moving robot 100*a* may recognize a relative position of the second moving robot 100*b*. That is, in the present disclosure, as long as each of the first moving robot 100*a* and the second moving robot 100*b* has the obstacle map for the same space, the first moving robot 100*a* and the second moving robot 100*b* may recognize each other's relative positions even when the coordinate system of the map is different from each other due to the use of different obstacle sensors, or even when the first moving robot 100*a* and the second moving robot 100*b* are not sufficiently close to transmit and receive short-range wireless signals.

Hereinafter, a method and system for controlling a plurality of moving robots according to embodiments of the present disclosure will be described with reference to FIG. 10. The control method may be performed by the controller 1800 and/or the controller 10 depending on embodiments or may be performed by at least one of the controller 1800, the controller 10, the terminal 300, and the server 500. The present disclosure may be a computer program implementing each step of the control method, or may be a recording medium on which a program for implementing the control method is recorded. The "recording medium" may refer to a computer-readable recording medium. The present disclosure may be a system including both hardware and software.

In some embodiments, it is also possible that the functions mentioned in the steps may be performed out of order. For example, two consecutive sequences may be executed simultaneously or in reverse order according to corresponding functions.

First, in order for cooperative cleaning to be performed by a plurality of moving robots, the moving robots may be selected as a single group, and an area in which the moving robots will perform cooperative cleaning may be designated.

Specifically, referring to FIG. 10, a method of controlling a plurality of moving robots may include a step of registering a plurality of moving robots (S10). The control method may further include, after the step S10, a step of receiving selective input of a cooperative cleaning mode by a user (S20). The control method may further include, after the step S20, a step of selecting a plurality of moving robots to be used for co-operative cleaning (which may be referred to as "cooperating robot cleaners") and selecting any one of a plurality of cooperation modes (S30). The control method may further include a step of performing cleaning by the moving robots (S90).

In the moving robot registration step S10, a plurality of moving robots 100*a* and 100*b* may be registered in the terminal 300. The plurality of moving robots 100*a* and 100*b* may be alternatively registered in the server 500.

The user may register moving robots that are connectable in a network by touching a product registration input interface on a screen of the terminal 300. When the product registration is complete, the registered moving robots may be displayed on the screen of the terminal 300.

In the cooperative cleaning selection step S20, the user may select a cooperative cleaning mode using the terminal 300. The above step S30 may include a moving robot selection step S30 of selecting a plurality of cooperating moving robots to perform co-operative cleaning among the registered moving robots.

For example, the user may select options to input Moving Robot 1 as the first moving robot 100*a*. In addition, in the above step S30, the user may select the second moving robot 100*b* among one or more options on the screen of the terminal 300. For example, the user may select options to input Moving Robot 2 (mop) as the second moving robot 100*b*. In the second embodiment to be described later, the user may select and input only the main moving robot among the plurality of cooperating moving robots.

The above step S30 may include a mode selection step S30 in which one of a plurality of cooperation modes is selected. The user may select, from among a plurality of options, any one corresponding to the cooperation mode that the user intends to select.

In the cleaning step S90, the cooperating moving robots 100*a* and 100*b* selected in the robot cleaner selection step S30 may perform cleaning. In the cleaning step S90, the moving robots 100*a* and 100*b* may perform cleaning according to the cooperation mode selected in the mode selection step S30.

In the above robot cleaner selection step S30, the first moving robot 100*a* and the second moving robot 100*b* may be selected from among a plurality of registered moving robots. The first moving robot 100*a* and the moving robot 100*b* may be cleaners selected to perform cooperative cleaning. After the step S30, when the terminal 300 gives instructions to the first moving robot 100*a* and the second moving robot 100*b* through the network, the first moving robot 100*a* and the second moving robot 100*b* may analyze their current state and may identify their position on the maps (S150*a* and S150*b*). After identifying the position (S150*a*), the first moving robot 100*a* may perform cooperative cleaning together with the second moving robot 100*b* (S90*a*). After identifying the position (S150*b*), the second moving robot 100*b* may perform co-operative cleaning together with the first moving robot 100*a* (S90*b*). The first moving robot 100*a* and the second moving robot 100*b* may exchange information with each other while performing cleaning (S90*a* and S90*b*) (S80).

Referring to FIGS. 11 and 12, a method controlling a plurality of moving robots according to a first embodiment of the present disclosure includes: a step of dividing the travelling area into at least a plurality of first region R1 and a second region R2 (S210); a step of detecting a sub-region in the first region R1 by the first moving robot 100*a* (S210); a first dry cleaning step (S220) of cleaning the first area R1, except the sub-region, by the first moving robot 100*a;* after the first moving robot 100*a* completes cleaning of the first region R1 except the sub-region, a second dry cleaning step (S250) of cleaning the second region R2; and after the first moving robot 100*a* completes cleaning of the first region R1 except the sub-region, a first wet cleaning step (S260) of cleaning the first region R1, except the sub-region, by the second moving robot 100*b*. The dividing step (S210) and the detecting step (S210) may be performed as a single step.

In addition, the method of controlling the plurality of moving robots according to the first embodiment may further include a third dry cleaning step (S290) of cleaning the sub-region in the first region R1 after the first moving robot 100*a* completes cleaning of the second region R2.

In another example of a method of controlling a plurality of moving robots according to the first embodiment of the present disclosure includes: a step of sequentially cleaning the divided first to p-th regions, except sub-regions, in the travelling area by the first moving robot 100*a;* a step of starting to clean an n-1 region, except the sub-regions, by the second moving robot 100*b;* and after the first moving robot 100*a* completes cleaning of the p-th region, a step of sequentially leaning the sub-regions in the first to p-th regions. Here, p is a natural number greater than or equal to 2, and n is a natural number between 2 and p.

Referring to FIGS. 11*a*, 11*b*, and 12, in the dividing step (S210) and the detecting step (S210), the first moving robot 100*a* specifies regions to be cleaned and travelling areas, divides the travelling area into the plurality of first and second regions R1 and R2, and specifies the sub-regions in the respective regions. Information on the travelling area, the plurality of first and second regions R1 and R2, and the sub-regions located in the respective regions may be received from a server, or another moving robot.

Specifically, the controller 1800 of the first moving robot 100*a* may control the travelling unit and the cleaning unit to generate an obstacle map of the areas to be cleaned, and to specify the sub-regions based on the values sensed by the sensing unit.

Specifically, in the above step S210, in the case where the first moving robot 100*a* has no map stored therein as in the initial traveling, the first moving robot 100*a* may travel in the travelling area and may generate a map by wall following and/or based on sensing information of the sensing unit 1400.

The first moving robot 100*a* may divide the generated map into a plurality of regions R1, R2, R3, R4, and R5. The travelling area may be divided into a plurality of regions R1, R2, R3, R4, and R5 by a predetermined algorithm.

For example, moving trajectories of the moving robot 100*a* every time the moving robot 100*a* travels predetermined distances may be grouped to be classified as any one region.

In another example, a plurality of regions may be classified based on a shape of the divided traveling area. Specifically, the moving robot 100*a* may classify the plurality of regions by recognizing the wall of each room, a door which opens and closes, or the like in the travelling area.

In yet another example, the travelling area may be divided into a plurality of regions based on the width of the divided regions. Specifically, the moving robot 100*a* may divide the travelling area into a plurality of regions each having a width according to criteria, and may classify a region, in which a wet obstacle Al is present, as a sub-region among the plurality of regions. The method of specifying the sub-region by the first moving robot 100*a* is described above.

In the first dry cleaning step S220, the first moving robot 100*a* cleans the first region R1 except the sub-region. The first moving robot 100*a* performs cleaning by suctioning dust and foreign matter without using water.

Then, the controller 1800 determines whether the first moving robot 100*a* completes cleaning of the first region R1 (S230). Referring to FIG. 11C, once the controller 1800 determines that the first moving robot 100*a* completes cleaning of the first region R1 except the sub-region, the moving robot 100*a* cleans the second region R2 (S250). Once the controller 1800 determines that the first moving robot 100*a* has not completed cleaning of the first region R1 except the sub-region, the moving robot 100*a* continues cleaning of the first region R1 (S240).

Once the controller 1800 determines that the first moving robot 100*a* completes cleaning of the first region R1 except the sub-region, the second moving robot 100*b* starts to clean the first region R1 except the sub-region (S260).

Subsequently, the controller 1800 determines whether the first moving robot 100*a* completes cleaning of the second region R2 (S270). Referring to FIG. 11D, once the controller 1800 determines that the moving robot 100*a* completes cleaning of the second region R2, the moving robot 100*a* cleans the sub-region in the first region R1 (S290). Once the controller 1800 determines that the moving robot 100*a* has completed cleaning of the second region R2, the second moving robot 100*b* may start to clean the second region R2 (S280).

Accordingly, in the control method of the present disclosure, in the case where sub-regions are present in the plurality of regions, the moving robots may efficiently perform cooperative cleaning. The control method imposes less burden but may be efficient only when performing different controlling operations according to the size of the respective regions and sub-regions. the following description will be given of another control method.

FIG. 13 is a flowchart illustrating a method of controlling a plurality of moving robots according to a second embodiment of the present disclosure.

The method of controlling the plurality of moving robots according to the second embodiment is performed in the same manner as the steps S210, S220, S230, S240, S250, and S260 of the first embodiment. Hereinafter, the second embodiment will be described based on differences from the first embodiment.

After the step S260, it is determined whether the first moving robot 100*a* has completed cleaning of the second region R2 (S270). Once it is determined that the first moving robot 100*a* has completed cleaning of the second region R2, it is determined whether the second moving robot 100*b* has completed cleaning of the first region R1 except the sub-region (S274).

Once it is determined that the second moving robot 100*b* has completed cleaning of the first region R1 except the sub-region, the second moving robot 100*b* starts to clean the second region R2 (S280), and the first moving robot 100*a* cleans the sub-region of the first region R1 (S290).

Once it is determined that the second moving robot 100*b* has not completed cleaning of the first region R1 except the sub-region, the first moving robot 100*a* waits in place (S277). Here, the moving robot 100*a* waiting in place may refer to a case where the first moving robot 100*a* waits at a position of the second region R2, where the first moving robot 100*a* has completed cleaning of the second region R2, or a case where the first moving robot 100*a* waits at a position of the second region R2 which is adjacent to the first region R1, or a case where the moving robot 100*a* waits in the vicinity of a position of the second region R2 which is connected to the first region R1.

Upon completing cleaning of the first region R1 except the sub-region, the second moving robot 100*b* transmits information, indicating that cleaning of the first region R1 is complete, to the first moving robot 100*a*.

Referring to FIG. 14, the method of controlling the plurality of moving robots according to a third embodiment is performed in the same manner as the steps S210, S220, S230, S240, S250, and S260 of the first embodiment. The third embodiment will be described below based on differences from the first embodiment.

After the step S260, it is determined whether the second moving robot 100*b* has completed cleaning of the first region R1 (S274). Once it is determined that the second moving robot 100*b* has completed cleaning of the first region R1 except the sub-region, the second moving robot 100*b* starts to clean the second region R2 (S280), and the first moving robot 100*a* cleans the sub-region of the first region R1 (S290).

Upon completing cleaning of the first region R1 except the sub-region, the second moving robot 100*b* transmits information, indicating that cleaning of the first region R1 is complete, to the first moving robot 100*a*.

FIG. 15 is a flowchart illustrating a method of controlling a plurality of moving robots according to a fourth embodiment of the present disclosure.

The method of controlling the plurality of moving robots according to the fourth embodiment is performed in the same manner as the steps S210, S220, S230, S240, S250, and S260 of the first embodiment. The fourth embodiment will be described below based on differences from the first embodiment.

After the step S260, it is determined whether the second moving robot 100*b* has completed cleaning of the first region R1 except the sub-region (S274). Once it is determined that the second moving robot 100*b* has completed cleaning of the first region R1 except the sub-region, it is determined whether the first moving robot 100*b* has completed cleaning of the second region R2 (S270).

Once it is determined that the first moving robot 100*a* has completed cleaning of the second region R2, the second moving robot 100*b* starts to clean the second region R2 (S280), and the first moving robot 100*a* cleans the sub-region of the first region R1 (S290).

Once it is determined that the first moving robot 100*a* has not completed cleaning of the second region R2, the second moving robot 100*b* waits in place (S279). Here, the second moving robot 100*b* waiting in place may refer to a case where the second moving robot 100*b* waits at a position of the first region R1, where the second moving robot 100*b* has completed cleaning of the first region R1, or a case where the second moving robot 100*b* waits at a position of the first region R1 which is adjacent to the second region R2, or a case where the second moving robot 100*b* waits in the vicinity of a position of the first region R1 which is connected to the second region R2.

Upon completing cleaning of the second region R2, the first moving robot 100*a* transmits information, indicating that cleaning of the second region R2 is complete, to the second moving robot 100*b*.

Hereinafter, a moving robot according to another embodiment of the present disclosure will be described.

Referring to FIG. 12, the moving robot according to another embodiment will be described based on differences from the embodiments of the FIGS. 5 to 7. Details not specifically described in FIG. 12 are considered the same as the embodiments of FIGS. 5 to 7.

In this embodiment, a position of the optical flow sensor 23*b*-1 is different when compared with the embodiments of FIGS. 5 to 7.

The optical flow sensor 23*b*-1 may be disposed between a front horizontal line FHL and a rear horizontal line RHL at a position biased to the rear horizontal line RHL. Specifically, the optical flow sensor 23*b*-1 may be disposed between a center horizontal line CHL and the rear horizontal line RHL at a position biased to the rear horizontal line RHL. Further, the optical flow sensor 23*b*-1 may be disposed at a position not overlapping the water tank 81 and the spin mop 41.

Accordingly, after the spin mop 41 completely removes liquid foreign matter from the floor, the optical flow sensor 23*b*-1 scans the floor, such that accurate images may be acquired, and accurate sensing may be provided.

In addition, as the optical flow sensor 23*b*-1 is biased from the geometric center Tc of the body 30, it is possible to easily detect the moving robot rotating in place.

While the present disclosure has been shown and described with reference to the preferred embodiments thereof, it should be understood that the present disclosure is not limited to the aforementioned specific embodiments, and various modifications and variations may be made by those skilled in the art without departing from the scope and spirit of the invention as defined by the appended claims, and the modified implementations should not be construed independently of the technical idea or prospect of the present disclosure.

The invention claimed is:

1. A method for controlling a plurality of moving robots, the method comprising:

dividing a traveling area into at least a plurality of regions, including a first region and a second region;

detecting, by a first moving robot, a sub-region in which a second moving robot is unable to enter or is difficult to perform cleaning;

performing a first dry cleaning of cleaning the first region except the sub-region, by the first moving robot;

upon completing cleaning of the first region, except the sub-region, by the first moving robot, performing a second dry cleaning of cleaning the second region by the first moving robot; and upon completing cleaning of the first region, except the sub-region, by the first moving robot, performing a first wet cleaning of starting to clean the first region, except the sub-region, by the second moving robot, and upon completing cleaning of the second region by the first moving robot, performing a third dry cleaning of cleaning the sub-region by the first moving robot, wherein the first moving robot detects the sub-region and communicates an information of the sub-region to the second moving robot, and wherein during the third dry cleaning, when the second moving robot is still cleaning the first region, the first moving robot waits in place at a location where the cleaning of the second region is completed, without returning to a docking station, and wherein when the second moving robot completes the cleaning of the first region, the first moving robot receives cleaning completion information from the second moving robot, releases the waiting, and starts the third dry cleaning for the sub-region.

2. The method of claim 1, further comprising, upon completing cleaning of the first region except the sub-region by the second moving robot, performing a second wet cleaning of starting to clean the second region by the second moving robot.

3. The method of claim 2, further comprising, upon completing cleaning of the first region except the sub-region by the second moving robot and upon completing cleaning of the second region by the first moving robot, performing the second wet cleaning of starting to clean the second region by the second moving robot.

4. The method of claim 2, wherein in the second wet cleaning, if the first moving robot is in a process of cleaning the second region, the second moving robot waits in place.

5. The method of claim 2, wherein upon completing cleaning of the second region by the first moving robot, the first moving robot transmits information, indicating that cleaning of the second region is complete, to the second moving robot.

6. The method of claim 1, wherein the first moving robot and the second moving robot share a map of the traveling area.

7. The method of claim 1, wherein:

the first moving robot suctions foreign matter; and the second moving robot performs mopping.

* * * * *